US008186570B2

(12) United States Patent
Learn

(10) Patent No.: US 8,186,570 B2
(45) Date of Patent: May 29, 2012

(54) PACKAGE FOR FOOD PRODUCT

(75) Inventor: Angela E. Learn, Gilbertsville, PA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 12/605,721

(22) Filed: Oct. 26, 2009

(65) Prior Publication Data

US 2010/0102111 A1 Apr. 29, 2010

Related U.S. Application Data

(60) Provisional application No. 61/197,174, filed on Oct. 24, 2008.

(51) Int. Cl.

| | |
|---|---|
| ***B65D 5/46*** | (2006.01) |
| ***B65D 5/54*** | (2006.01) |
| ***B65D 5/42*** | (2006.01) |
| ***B31B 1/26*** | (2006.01) |
| ***B65B 7/26*** | (2006.01) |

(52) U.S. Cl. ..... 229/125.19; 229/117.12; 229/210; 229/126

(58) Field of Classification Search ..... 229/117.12, 229/125.19, 126, 210, 123.3, 902; 53/484
See application file for complete search history.

(56) References Cited

U.S. PATENT DOCUMENTS

| | | | | |
|---|---|---|---|---|
| 499,655 | A | | 6/1893 | Clark |
| 1,503,161 | A | | 7/1924 | Hornecker |
| 1,634,073 | A | | 6/1927 | Labombarde |
| 1,656,919 | A | | 1/1928 | Marsh |
| 1,762,704 | A | | 6/1930 | Smith |
| 1,901,483 | A | | 3/1933 | Ware, Jr. |
| 1,925,102 | A | | 9/1933 | Levkoff |
| 1,951,408 | A | | 3/1934 | Haven |
| 2,027,079 | A | | 1/1936 | Weiss |
| 2,141,743 | A | | 12/1938 | Ethridge |
| 2,145,430 | A | | 1/1939 | New |
| 2,147,563 | A | * | 2/1939 | Turner ..... 229/109 |
| 2,152,079 | A | | 3/1939 | Mott |
| 2,196,243 | A | | 4/1940 | Bensel |
| 2,290,971 | A | | 7/1942 | King |
| 2,330,294 | A | | 9/1943 | Leavitt et al. |
| 2,409,692 | A | * | 10/1946 | Nyberg ..... 229/210 |
| 2,416,332 | A | | 2/1947 | Lehman |
| 2,643,589 | A | | 6/1953 | Weiss |

(Continued)

FOREIGN PATENT DOCUMENTS

| | | |
|---|---|---|
| DE | 2 320 190 | 11/1973 |

(Continued)

OTHER PUBLICATIONS

International Search Report mailed Jun. 10, 2010 for application—PCT/US2009/062044—Graphic Packaging International, Inc.

(Continued)

*Primary Examiner* — Nathan J Newhouse
*Assistant Examiner* — Christopher Demeree
(74) *Attorney, Agent, or Firm* — Womble Carlyle Sandridge & Rice, LLP

(57) ABSTRACT

A package for holding a food product that has a tray and a lid. The tray has a central panel for supporting a food product. The package includes various closing and opening features.

24 Claims, 19 Drawing Sheets

U.S. PATENT DOCUMENTS

| | | | | |
|---|---|---|---|---|
| 2,643,812 | A * | 6/1953 | Lange | 229/186 |
| 2,679,349 | A | 5/1954 | Mullinix | |
| 2,710,134 | A | 6/1955 | Schroeder et al. | |
| 2,791,362 | A | 5/1957 | Nute | |
| 2,875,938 | A | 3/1959 | Bramhill | |
| 3,002,613 | A | 10/1961 | Merkel et al. | |
| 3,090,483 | A | 5/1963 | Altree et al. | |
| 3,157,342 | A | 11/1964 | Grady | |
| 3,197,115 | A * | 7/1965 | Fritz | 229/227 |
| 3,265,283 | A | 8/1966 | Farquhar | |
| 3,276,665 | A | 10/1966 | Rasmussen | |
| 3,280,968 | A | 10/1966 | Craine | |
| 3,434,648 | A | 3/1969 | Du Barry, Jr. | |
| 3,653,495 | A | 4/1972 | Gray | |
| 3,677,458 | A | 7/1972 | Gosling | |
| 3,759,378 | A | 9/1973 | Werth | |
| 3,786,914 | A | 1/1974 | Beutler | |
| 3,884,348 | A | 5/1975 | Ross | |
| 4,008,849 | A | 2/1977 | Baber | |
| 4,113,100 | A | 9/1978 | Soja et al. | |
| 4,519,538 | A | 5/1985 | Omichi | |
| 4,558,785 | A | 12/1985 | Gordon | |
| 4,586,643 | A | 5/1986 | Halabisky et al. | |
| 4,742,917 | A | 5/1988 | Bornwasser | |
| 4,760,952 | A | 8/1988 | Wachter et al. | |
| 4,773,541 | A | 9/1988 | Riddell | |
| 4,815,609 | A | 3/1989 | Kiedaisch | |
| 4,886,160 | A | 12/1989 | Kilgerman | |
| 642,121 | A | 1/1990 | Hildreth | |
| 5,105,950 | A * | 4/1992 | Gottfreid et al. | 229/210 |
| 5,181,650 | A | 1/1993 | Hollander et al. | |
| 5,368,194 | A | 11/1994 | Oliff et al. | |
| 5,419,486 | A * | 5/1995 | Bennett et al. | 229/109 |
| 5,505,369 | A * | 4/1996 | Taliaferro | 229/122.32 |
| 5,699,957 | A | 12/1997 | Blin et al. | |
| 5,722,583 | A | 3/1998 | Focke et al. | |
| 5,783,030 | A | 7/1998 | Walsh | |
| 5,788,117 | A | 8/1998 | Zimmanck | |
| 5,842,576 | A | 12/1998 | Snow | |
| 5,857,570 | A | 1/1999 | Brown | |
| 5,878,947 | A | 3/1999 | Hoy et al. | |
| 5,881,884 | A | 3/1999 | Podosek | |
| 5,921,398 | A | 7/1999 | Carroll | |
| 5,927,498 | A | 7/1999 | Saam | |
| 5,979,749 | A | 11/1999 | Bozich | |
| 6,015,084 | A | 1/2000 | Mathieu et al. | |
| D431,462 | S | 10/2000 | Menaged et al. | |
| 6,129,211 | A | 10/2000 | Prakken et al. | |
| 6,135,289 | A | 10/2000 | Miller | |
| 6,158,579 | A | 12/2000 | Rosenbaum | |
| 6,223,978 | B1 * | 5/2001 | Drager | 229/109 |
| 6,386,369 | B2 | 5/2002 | Yuhas et al. | |
| 6,419,152 | B1 | 7/2002 | Tokarski | |
| 6,435,351 | B1 | 8/2002 | Gibb | |
| 6,478,159 | B1 | 11/2002 | Taylor et al. | |
| 6,510,982 | B2 | 1/2003 | White | |
| 6,523,692 | B2 | 2/2003 | Gregory | |
| 6,729,475 | B2 | 5/2004 | Yuhas et al. | |
| 6,854,639 | B2 | 2/2005 | Walsh | |
| 6,913,189 | B2 | 7/2005 | Oliff et al. | |
| 6,918,487 | B2 | 7/2005 | Harrelson | |
| 6,923,365 | B2 | 8/2005 | Auclair et al. | |
| 7,021,468 | B2 | 4/2006 | Cargile, Jr. | |
| 7,201,714 | B2 | 4/2007 | Zoeckler et al. | |
| 7,225,930 | B2 | 6/2007 | Ford et al. | |
| 7,284,662 | B2 | 10/2007 | DeBusk et al. | |
| 7,293,652 | B2 | 11/2007 | Learn et al. | |
| 7,328,834 | B2 | 2/2008 | Harrelson | |
| 7,398,631 | B2 | 7/2008 | Learn | |
| 7,398,632 | B2 | 7/2008 | Learn et al. | |
| 2001/0001447 | A1 | 5/2001 | Gregory | |
| 2002/0043554 | A1 | 4/2002 | White | |
| 2002/0170845 | A1 | 11/2002 | Oliff | |
| 2004/0099570 | A1 | 5/2004 | Cargile | |
| 2005/0092649 | A1 | 5/2005 | Ford et al. | |
| 2005/0167291 | A1 | 8/2005 | Sutherland | |
| 2005/0199690 | A1 | 9/2005 | Peterson | |
| 2005/0218203 | A1 | 10/2005 | Harrelson | |
| 2006/0243739 | A1 | 11/2006 | Sherman et al. | |
| 2006/0266815 | A1 | 11/2006 | Coltri-Johnson et al. | |
| 2007/0000934 | A1 | 1/2007 | Wolpow | |
| 2007/0267471 | A1 | 11/2007 | Falana | |

FOREIGN PATENT DOCUMENTS

| | | | |
|---|---|---|---|
| DE | 36 27 019 | A1 | 2/1988 |
| DE | 298 17 195 | U1 | 11/1998 |
| DE | 202 16 854 | U1 | 1/2003 |
| EP | 0 133 595 | A2 | 2/1985 |
| EP | 0 704 386 | A1 | 4/1996 |
| FR | 1.379.931 | | 12/1963 |
| FR | 2 882 032 | | 8/2006 |
| GB | 1 218 016 | | 1/1971 |
| JP | 5-75116 | U | 10/1993 |
| KR | 20-0284781 | Y1 | 8/2002 |
| KR | 20-0304526 | Y1 | 2/2003 |
| WO | WO 98/31593 | | 7/1998 |
| WO | WO 03/082686 | A1 | 10/2003 |
| WO | WO 2004/063031 | A1 | 7/2004 |
| WO | WO 2005/110866 | A1 | 11/2005 |

OTHER PUBLICATIONS

Written Opinion mailed Jun. 10, 2010 for application—PCT/US2009/062044—Graphic Packaging International, Inc.

* cited by examiner

PACKAGE FOR FOOD PRODUCT

CROSS-REFERENCE TO RELATED APPLICATIONS

This application claims the benefit of U.S. Provisional Application No. 61/197,174, which was filed on Oct. 24, 2008.

INCORPORATION BY REFERENCE

U.S. Provisional Application No. 61/197,174, which was filed on Oct. 24, 2008, is hereby incorporated by reference for all purposes as if presented herein in its entirety.

BACKGROUND OF THE DISCLOSURE

The present disclosure relates to the field of food packaging, and in particular, relates to packages, cartons, materials, and constructs that may be used to hold a food product.

SUMMARY OF THE DISCLOSURE

In general, one aspect of the disclosure is generally directed to a package comprising a tray and a lid. The tray has a central panel for supporting a food product. The package includes various closing and opening features.

In another aspect, the disclosure is generally directed to a package for holding a food product. The package comprises a tray for holding the food product. The tray comprises a tray central panel, a first tray side panel foldably connected to the tray central panel, a second tray side panel foldably connected to the tray central panel, a plurality of first tray end panels foldably connected to the tray central panel at a first end of the tray central panel, and a plurality of second tray end panels foldably connected to the central panel at a second end of the central panel. The package comprises a lid for covering the tray. The lid comprises a lid central panel, at least one lid side panel foldably connected to the lid central panel, and at least one lid end panel foldably connected to the lid central panel at one of a first end and a second end of the lid central panel.

In another aspect, the disclosure is generally directed to a combination of a tray blank and a lid blank for forming a package for holding a food product. The tray blank being for forming a tray for holding the food product. The tray blank comprises a tray central panel, a first tray side panel foldably connected to the tray central panel, a second tray side panel foldably connected to the tray central panel, a plurality of first tray end panels foldably connected to the tray central panel at a first end of the tray central panel, and a plurality of second tray end panels foldably connected to the central panel at a second end of the central panel. The lid blank being for forming a lid for covering the tray. The lid blank comprising a lid central panel, at least one lid side panel foldably connected to the lid central panel, and at least one lid end panel foldably connected to the lid central panel at one of a first end and a second end of the lid central panel.

In another aspect, the disclosure is generally directed to a blank for forming a package for holding a food product. The blank comprises a tray portion for forming a tray for holding the food product. The tray portion comprises a tray central panel, a first tray side panel foldably connected to the tray central panel, a second tray side panel foldably connected to the tray central panel, a plurality of first tray end panels foldably connected to the tray central panel at a first end of the tray central panel, and a plurality of second tray end panels foldably connected to the central panel at a second end of the central panel. The blank comprises a lid portion foldably connected to the tray portion. The lid portion is for forming a lid for covering the tray. The lid portion comprises a lid central panel, at least one lid side panel foldably connected to the lid central panel, and at least one lid end panel foldably connected to the lid central panel at one of a first end and a second end of the lid central panel.

In another aspect, the disclosure is generally directed to a method of forming a package for holding a food product. The method comprises obtaining a tray blank. The tray blank comprises a tray central panel, a first tray side panel foldably connected to the tray central panel, a second tray side panel foldably connected to the tray central panel, a plurality of first tray end panels foldably connected to the tray central panel at a first end of the tray central panel, and a plurality of second tray end panels foldably connected to the central panel at a second end of the central panel. The method comprises obtaining a lid blank. The lid blank comprises a lid central panel, at least one lid side panel foldably connected to the lid central panel, and at least one lid end panel foldably connected to the lid central panel at one of a first end and a second end of the lid central panel. The method comprises forming the tray from the tray blank, forming the lid from the lid blank, and positioning the lid to cover the tray and close the package.

In another aspect, the disclosure is generally directed to a method of forming a package for holding a food product. The method comprises obtaining a blank having a tray portion and a lid portion foldably connected to the tray portion. The tray portion comprises a tray central panel, a first tray side panel foldably connected to the tray central panel, a second tray side panel foldably connected to the tray central panel, a plurality of first tray end panels foldably connected to the tray central panel at a first end of the tray central panel, and a plurality of second tray end panels foldably connected to the central panel at a second end of the central panel. The lid portion comprises a lid central panel, at least one lid side panel foldably connected to the lid central panel, and at least one lid end panel foldably connected to the lid central panel at one of a first end and a second end of the lid central panel. The method further comprises forming the tray portion into a tray, forming the lid portion into a lid hingedly connected to the tray, and closing the package by covering the tray with the lid.

Those skilled in the art will appreciate the above stated advantages and other advantages and benefits of the illustrated embodiments and various additional embodiments reading the following detailed description of the illustrated embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure relates generally to various aspects of materials, blanks, packages, cartons, constructs, etc., for holding food items, and methods of making such materials, blanks, packages, cartons, and constructs. Although several different disclosures, aspects, implementations, and embodiments are provided, numerous interrelationships between, combinations thereof, and modifications of the various disclosures, aspects, implementations, and embodiments are contemplated hereby.

FIGS. 1-3B illustrate various features of a first embodiment of the disclosure. In the first embodiment, a package 3 (FIG. 3A) comprises a tray 5 and a lid 7. One or more food products (not shown) can be contained in the package 3. In the illustrated embodiment, the package 3 is for containing multiple food products comprising an entire meal or snack, but the package can be used to contain a single food product. The food products can be contained in additional packaging and then placed in the package 3 without departing from this disclosure.

Figure 1:
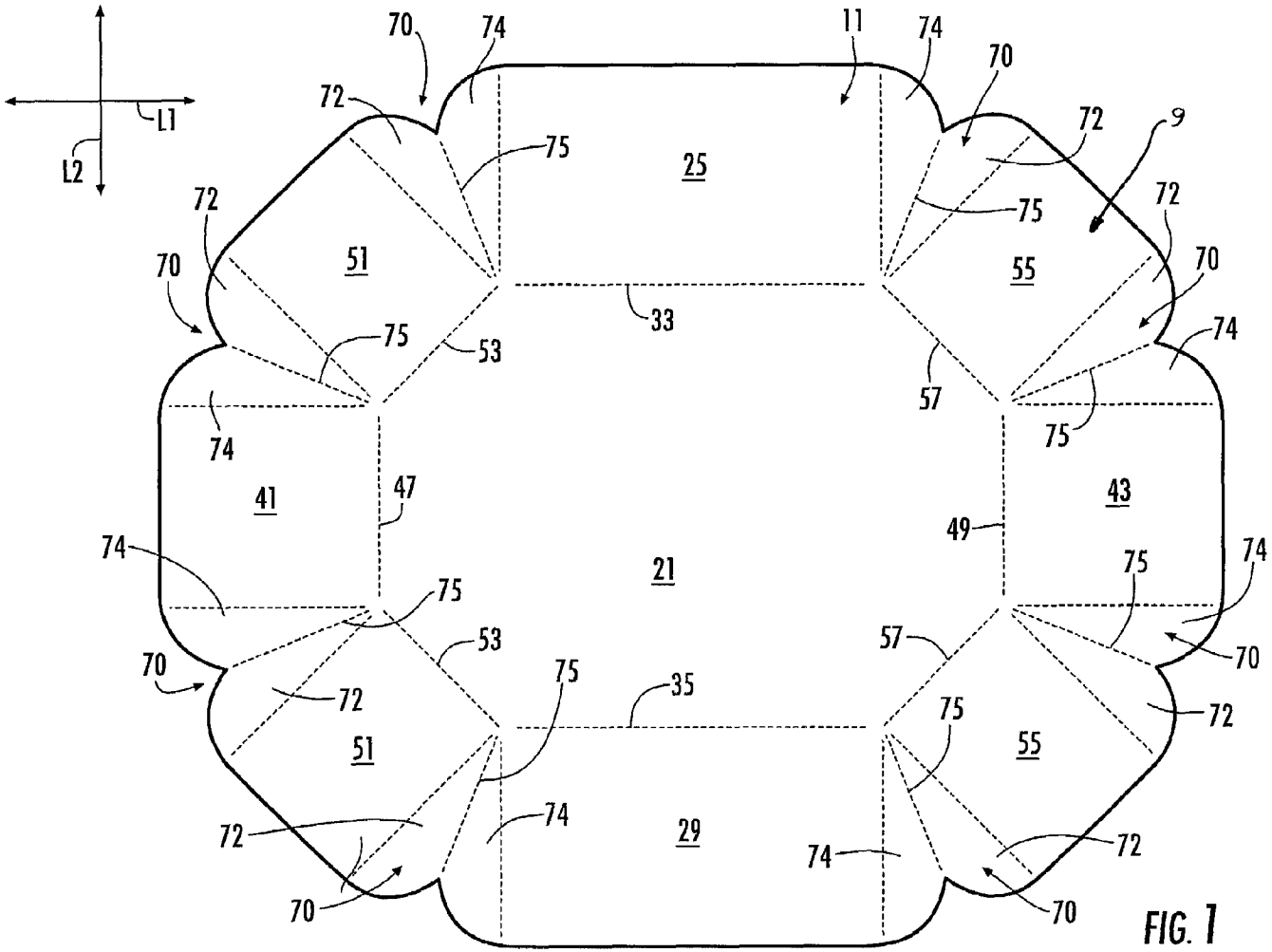
FIGS. 1-3B illustrate a first embodiment of the disclosure.

FIG. 1 shows an exterior surface 9 of a tray blank 11 used to form the tray 5. The tray blank 11 has a longitudinal axis L1 and a lateral axis L2. The blank 11 includes a tray central panel 21 and first and second tray side panels 25, 29 at respective lateral ends of the tray central panel. The tray side panels 25, 29 are respectively foldably connected to the tray central panel 21 at respective longitudinal fold lines 33, 35. First and second tray end panels 41, 43 are foldably connected to the tray central panel 21 at respective longitudinal ends of the tray central panel. The tray end panels 41, 43 are foldably connected to the tray central panel 21 at respective lateral fold lines 47, 49. Additional tray end panels 51 are positioned between each of the tray side panels 25, 29 and the first tray end panel 41 and are foldably connected to the tray central panel 21 at respective oblique fold lines 53. Additional tray end panels 55 are positioned between each of the tray side panels 25, 29 and the second tray end panel 43 and are foldably connected to the tray central panel 21 at respective oblique fold lines 57. In one embodiment, the longitudinal fold lines 33, 35, lateral fold lines 47, 49 and oblique fold lines 53, 57 combine to form eight respective edges of the tray central panel 21 so that the tray central panel is generally octagonal-shaped. The tray blank 11 can have other end panel arrangements and the central panel can be otherwise shaped without departing from the disclosure.

In one embodiment, the tray blank 11 includes gussets 70 respectively connecting adjacent tray end panels 41, 43, 51, 55 and tray side panels 25, 29. Each gusset 70 comprises a first gusset panel 72 foldably connected to a second gusset panel 74 at an oblique fold line 75. The gusset panels 72, 74 are generally triangular panels, but the gusset panels and fold lines 75 could be otherwise shaped, arranged, and positioned without departing from the disclosure.

Figure 2:
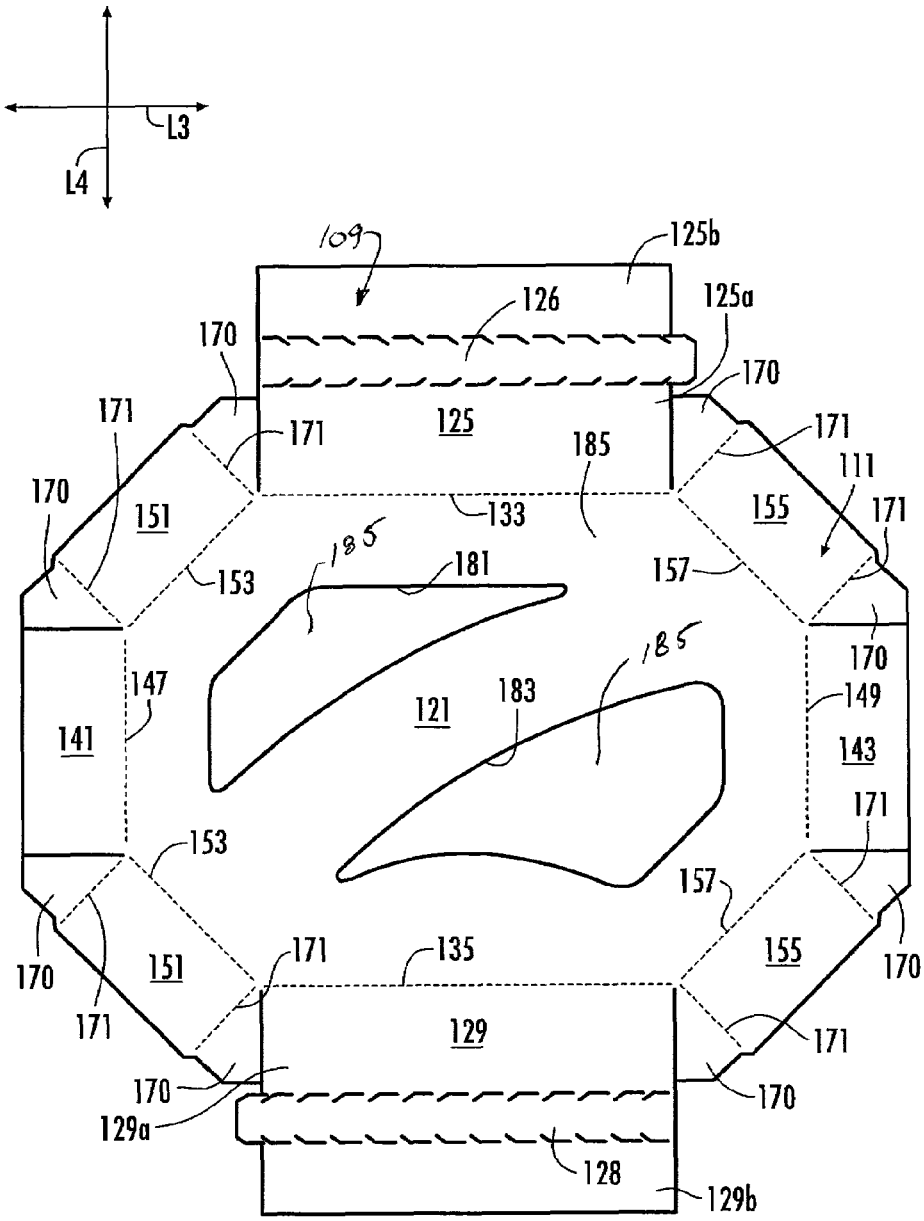
Figure 3A:
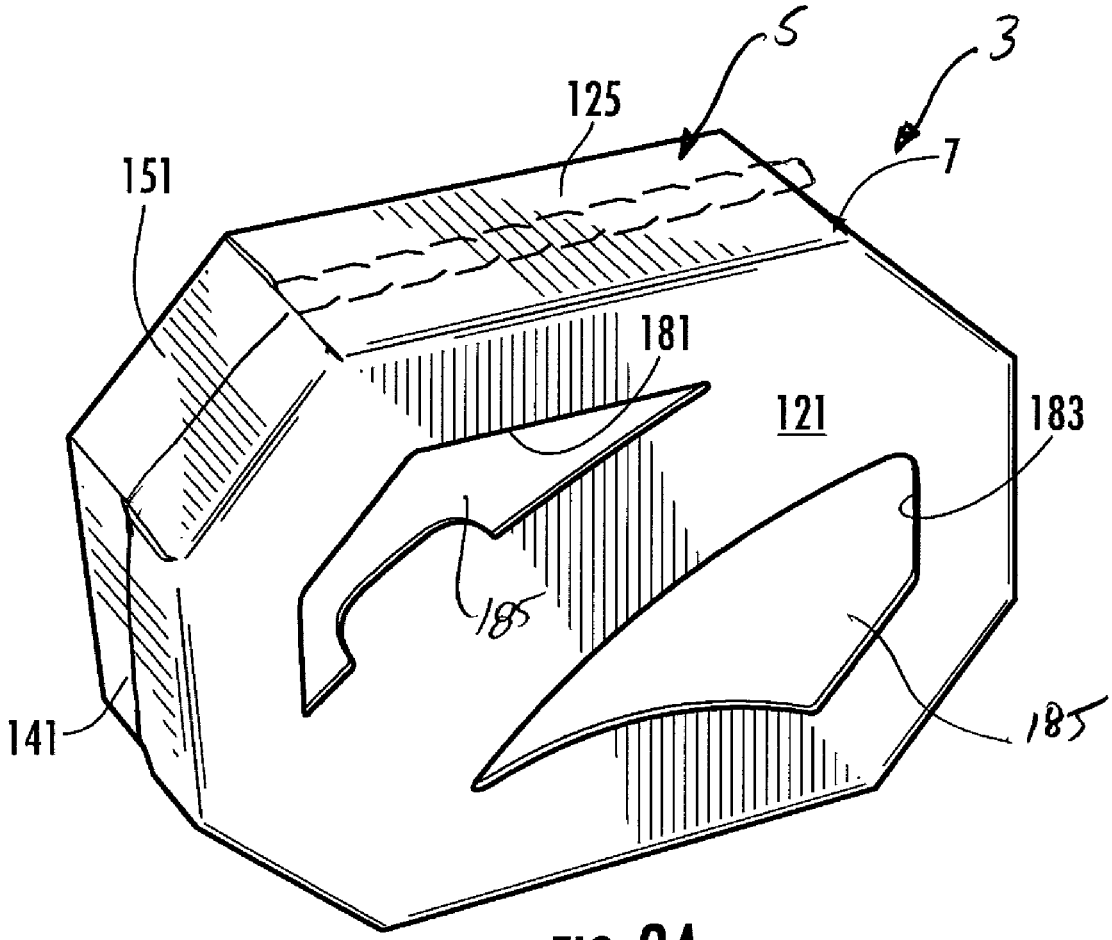
Figure 3B:
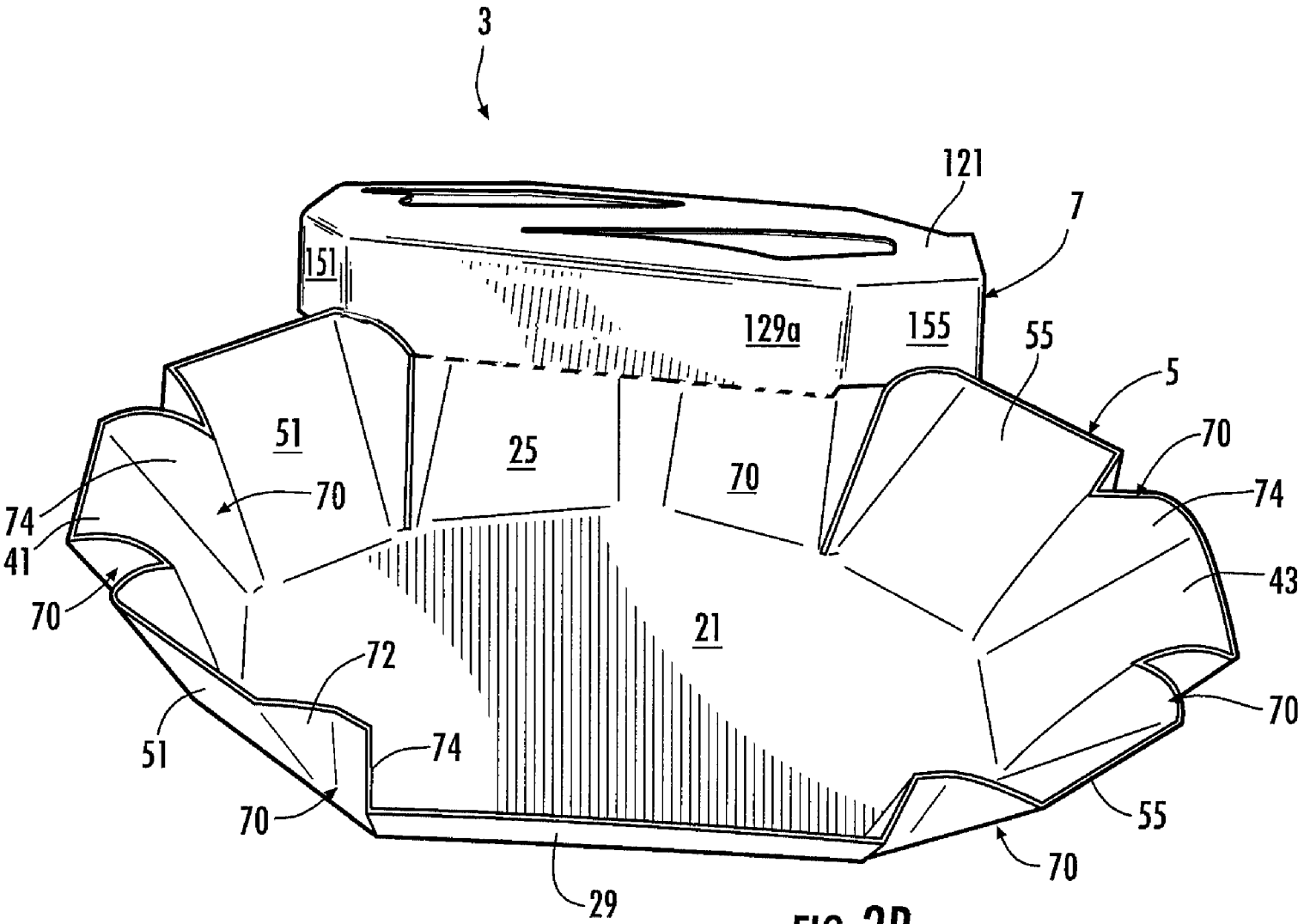

FIG. 2 illustrates an exterior surface 109 of a lid blank 111 used to form the lid 7 according to one embodiment of the disclosure. The lid blank 111 includes a longitudinal axis L3 and lateral axis L4. The lid blank 111 includes a lid central panel 121 and lid side panels 125, 129 foldably connected to the lid central panel at respective longitudinal fold lines 133, 135. Lid end panels 141, 143 are respectively foldably connected to the lid central panel at lateral fold lines 147, 149. Additional lid end panels 151 are positioned between the first vend panel 141 and a respective one of the lid side panels 125, 129 and are foldably connected to the lid central panel at oblique fold lines 153. Additional lid end panels 155 are positioned between the lid second end panel 143 and a respective one of the lid side panels 125, 129 and are foldably connected to the lid central panel at oblique fold lines 157. The longitudinal fold lines 133, 135, lateral fold lines 147, 149 and oblique fold lines 153, 157 combine to form eight respective edges of the lid central panel 121 so that the lid central panel is generally octagonal-shaped. The lid blank 111 can have other end panel arrangements and the lid central panel 121 can be otherwise shaped without departing from the disclosure.

In one embodiment, the lid blank 111 includes lid end flaps 170 foldably connected to lid end panels 151, 153 at oblique fold lines 171. The lid end flaps 170 are generally triangular flaps, but the lid end flaps and fold lines 171 could be otherwise, shaped, arranged, and positioned without departing from the disclosure.

In the illustrated embodiment, the lid central panel 121 of the lid blank 111 includes two apertures 181, 183. In one embodiment, the apertures 181, 183 are covered by suitable transparent film 185 (e.g., polyurethane) that is adhesively attached to the lid central panel 121. The apertures 181, 183 could be otherwise shaped, arranged, or omitted without departing from the disclosure.

In the illustrated embodiment, each lid side panel 125, 129 includes a tear strip 126, 128. The tear strips 126, 128 divide a respective lid side panel 125, 129 into a respective upper portion 125*a*, 129*a* and lower portion 125*b*, 129*b*. The lower portion 125*b*, 129*b* of each lid side panel 125, 129 can be adhesively connected to a respective lid side panel 25, 29 of the tray when the lid 7 is attached to the tray. When the tear strips 126, 128 are removed, the lower portions 125*b*, 129*b* remain attached to the lid side panels 25, 29 when the lid 7 is separated from the tray 5.

The package 3 is formed from the blanks 11, 111 by forming the tray blank 11 into the tray 5, forming the lid blank 111 into the lid 7, placing a food product on the tray, and attaching the lid to the tray. The tray 5 is formed by upwardly folding the tray side panels 25, 29 and tray end panels 41, 43, 51, 55 relative to the tray central panel 21 of the tray blank 11. The lid 7 is formed by downwardly folding the lid side panels 125, 129 and lid end panels 141, 143, 151, 155 relative to the lid central panel 121 of the lid blank 111. Food products (not shown) can be placed in the tray 5 and the lid 7 can be placed over the top of the tray. The lower portions 125*b*, 129*b* of the lid side panels 125, 129 of the lid 7 can be adhesively attached to the tray side panels 25, 29 of the tray 5. The lid 7 can be separated from the tray 5 in order to open the package 3 by tearing the tear strips 126, 128 in the lid side panels 125, 129 of the lid. After separating the lid 7 from the tray 5, the lid can be removed from the tray and the tray can outwardly expand by downwardly folding the tray side panels 25, 29 and tray end panels 41, 43, 51, 55 relative to the tray central panel 21. The tray 5 can be laid flat and used as a placemat for eating the food product that was previously contained in the package 3.

The package 3 can be formed, closed, and/or opened by other alternative methods and steps without departing from the disclosure. For example, the lid 7 can remain hingedly connected to the tray 5 by only tearing one of the tear strips 126, 128, so that the lid 7 would then remain hingedly connected to the tray 5 by the other of the lower portions 125*b*, 129*b* that is adhesively connected to the tray. Upon tearing of the other of the tear strips 126, 128, the lid 7 can be removed from the tray 5.

Figure 4:
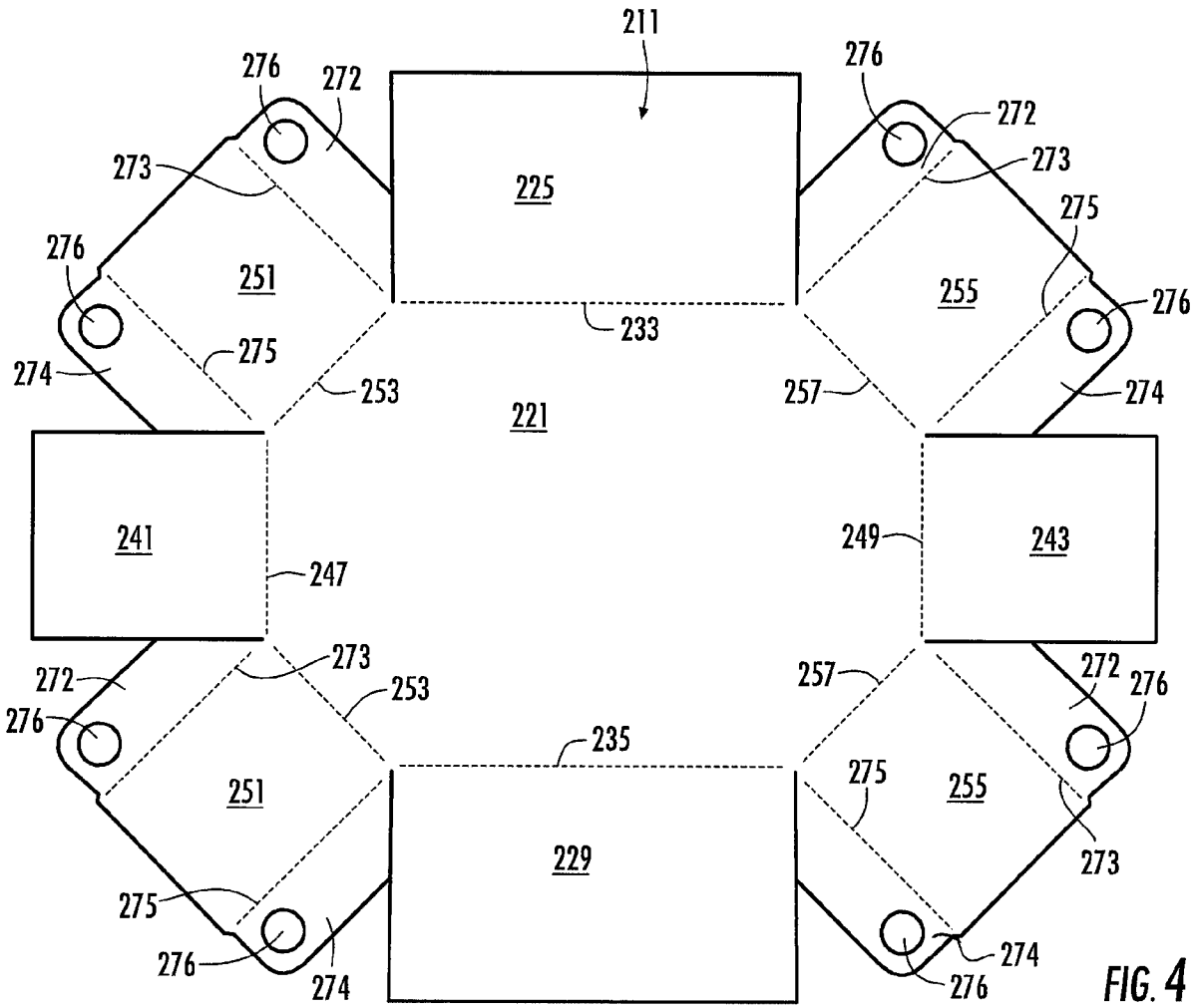
FIGS. 4-6C illustrate a second embodiment of the disclosure.
Figure 5:
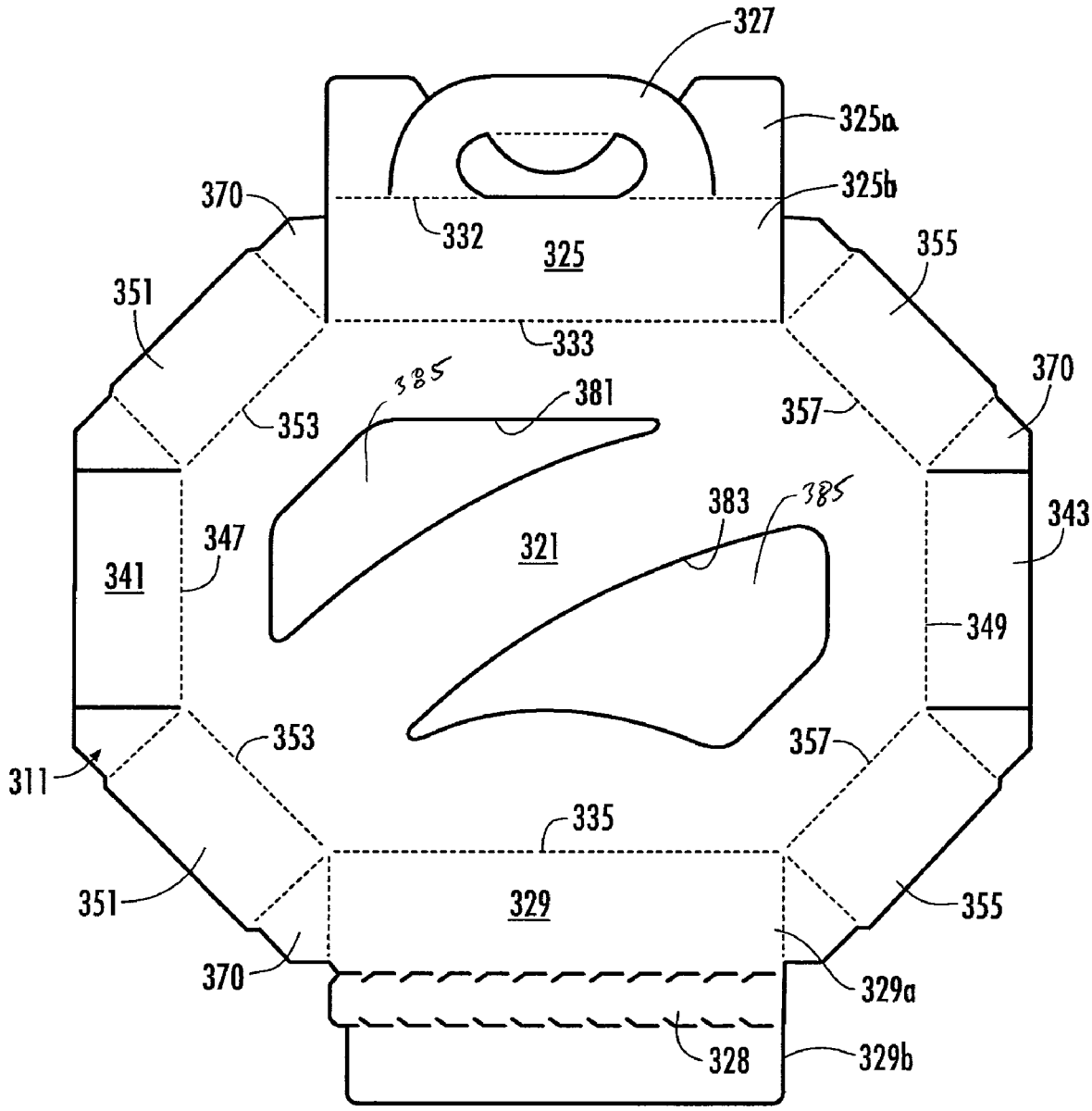
Figure 6A:
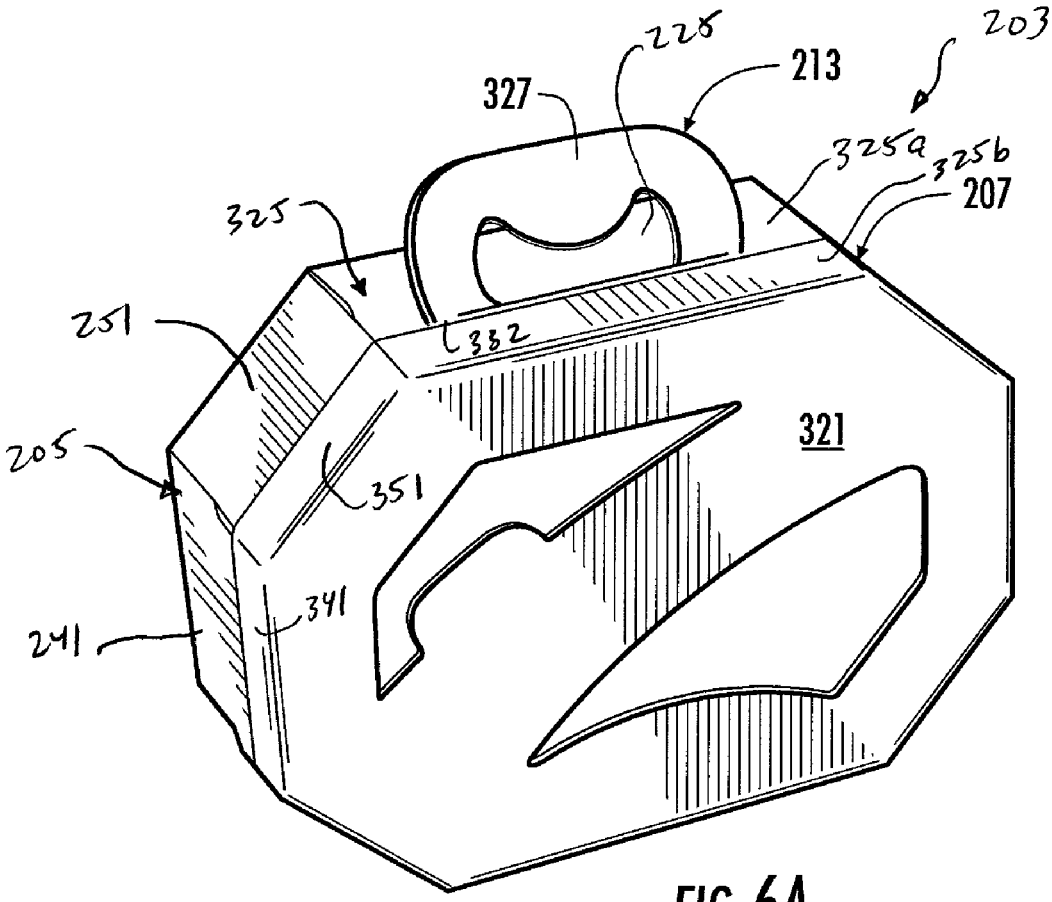
Figure 6B:
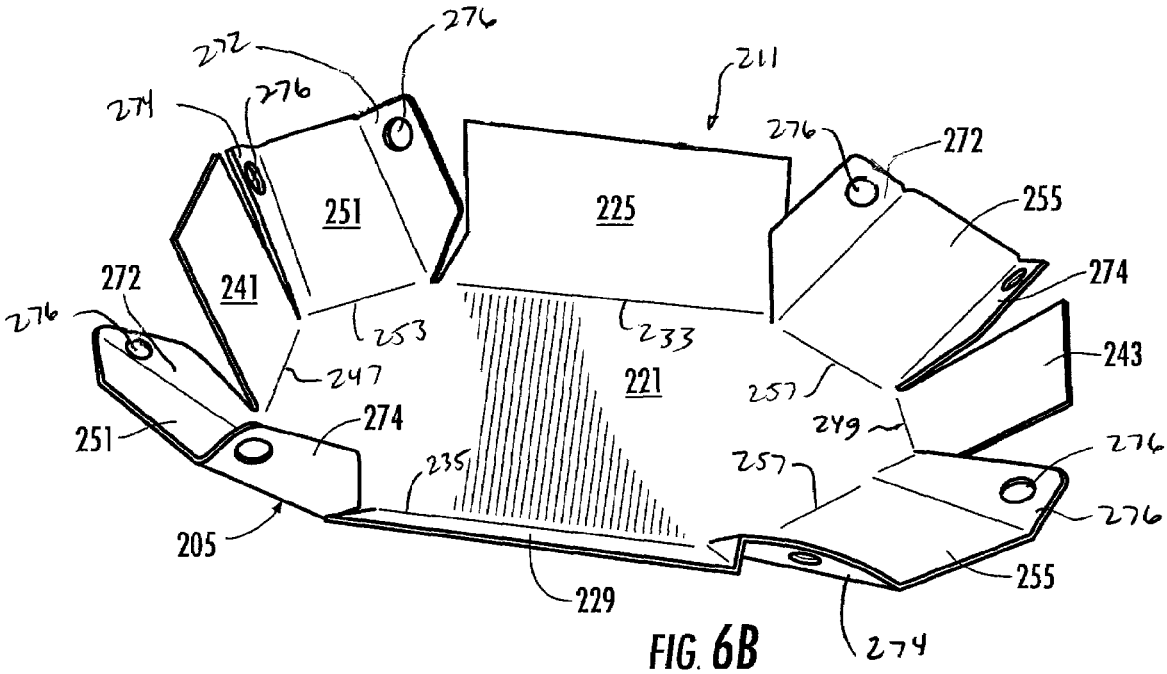
Figure 6C:
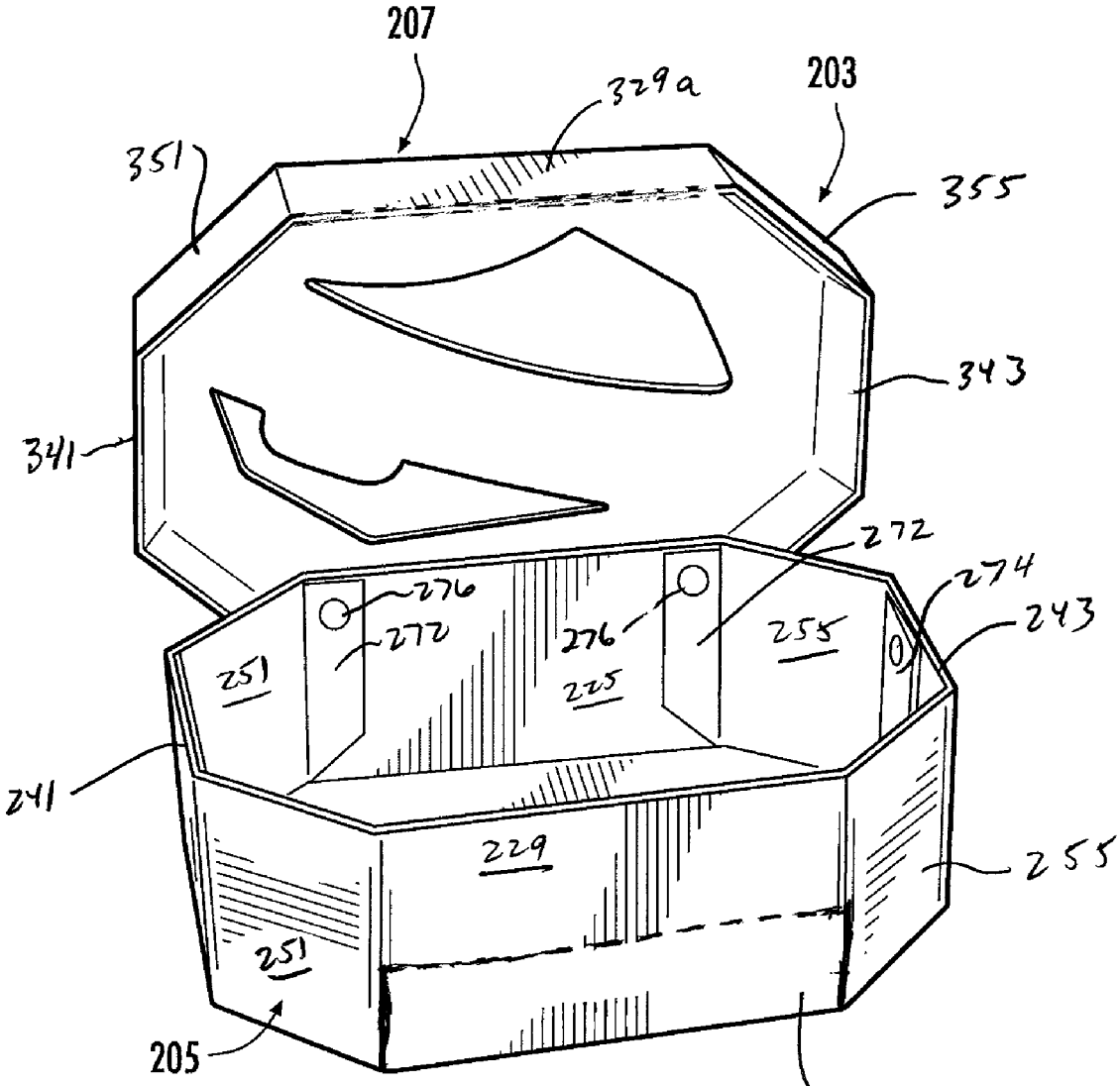

FIGS. 4-6B illustrate a second embodiment of the disclosure that comprises a package 203 having similar features as the first embodiment. Accordingly, similar or identical features of the embodiments are provided with like reference numbers. FIG. 4 illustrates a tray blank 211 for forming the tray 205 of the package 203, and FIG. 5 illustrates a lid blank 311 for forming the lid 207 of the package. The tray blank 211 includes a tray central panel 221, tray side panels 225, 229, and tray end panels 241, 243, 251, 255 similar to the first embodiment. Each of the tray end panels 251, 255 includes a respective pair of tray end flaps 272, 274 foldably connected to a respective end panel at an oblique fold line 273, 275. In the illustrated embodiment, each of the tray end flaps 272, 274 includes adhesive 276 such as glue. The adhesive 276 can be located on other panels or flaps (e.g., tray side panels 225, 229 and/or tray end panels 241, 243) without departing from the disclosure. The tray blank 211 can be otherwise shaped, arranged, and configured without departing from the disclosure.

The lid blank 311 is generally similar to the lid blank 111 of the first embodiment. The lid blank 311 includes a lid central panel 321, lid side panels 325, 329, lid end panels 341, 343, 351, 355, and lid end flaps 370 similar to the corresponding features of the lid blank 111 of the first embodiment. In the second embodiment, the first lid side panel 325 of the lid blank 311 has a lower portion 325*a* that includes a handle panel 327 foldably connected to the first lid side panel at a longitudinal fold line 332. The first lid side panel 325 has an upper portion 325*b* foldably connected to the lid central panel at fold line 333. The second lid side panel 329 has an upper portion 329*a*, lower portion 329*b*, and a tear strip 328 connecting the upper and lower portions. The lower portion 329*b* can be adhesively connected to the lid side panel 229 of the tray 205 when the package 203 is formed. The lid blank 311 has apertures 381, 383 that can be covered by transparent film 385 attached to the lid central panel 321. The lid blank 311 can be otherwise shaped, arranged, and configured without departing from the disclosure.

The package 203 of the second embodiment is formed in a similar manner as the package 3 of the first embodiment. The glue 276 on the tray end flaps 272, 274 releasably attaches the tray end panels 251, 255 to a respective one of the tray side panels 225, 229 and a respective one of the tray end panels 241, 243 to assist in maintaining the tray blank 211 in the formed position with the tray end panels and tray side panels upwardly struck from the tray central panel 221. The adhesive 276 can be a releasable adhesive that allows the tray end panels 251, 255 to be separated from the tray side panels 225, 229 and tray end panels 241, 243 so that the tray 205 can be flattened and used as a placemat in as similar manner as the first embodiment. Alternatively, the adhesive 276 could be substantially permanent adhesive that does not allow disassembly of the tray 205 without tearing or otherwise separating the tray end flaps 272, 274 from respective tray end panels 241, 243 and tray side panels 225, 229.

The handle panel 327 can be folded relative to the lid side panel 325 of the lid 207 to form a handle 213 of the package 203. The handle 213 could include other features (e.g., panels, flaps, etc.) without departing from the scope of the disclosure. Further, the handle 213 could be omitted or otherwise positioned on the package 203 without departing from the disclosure.

Figure 7:
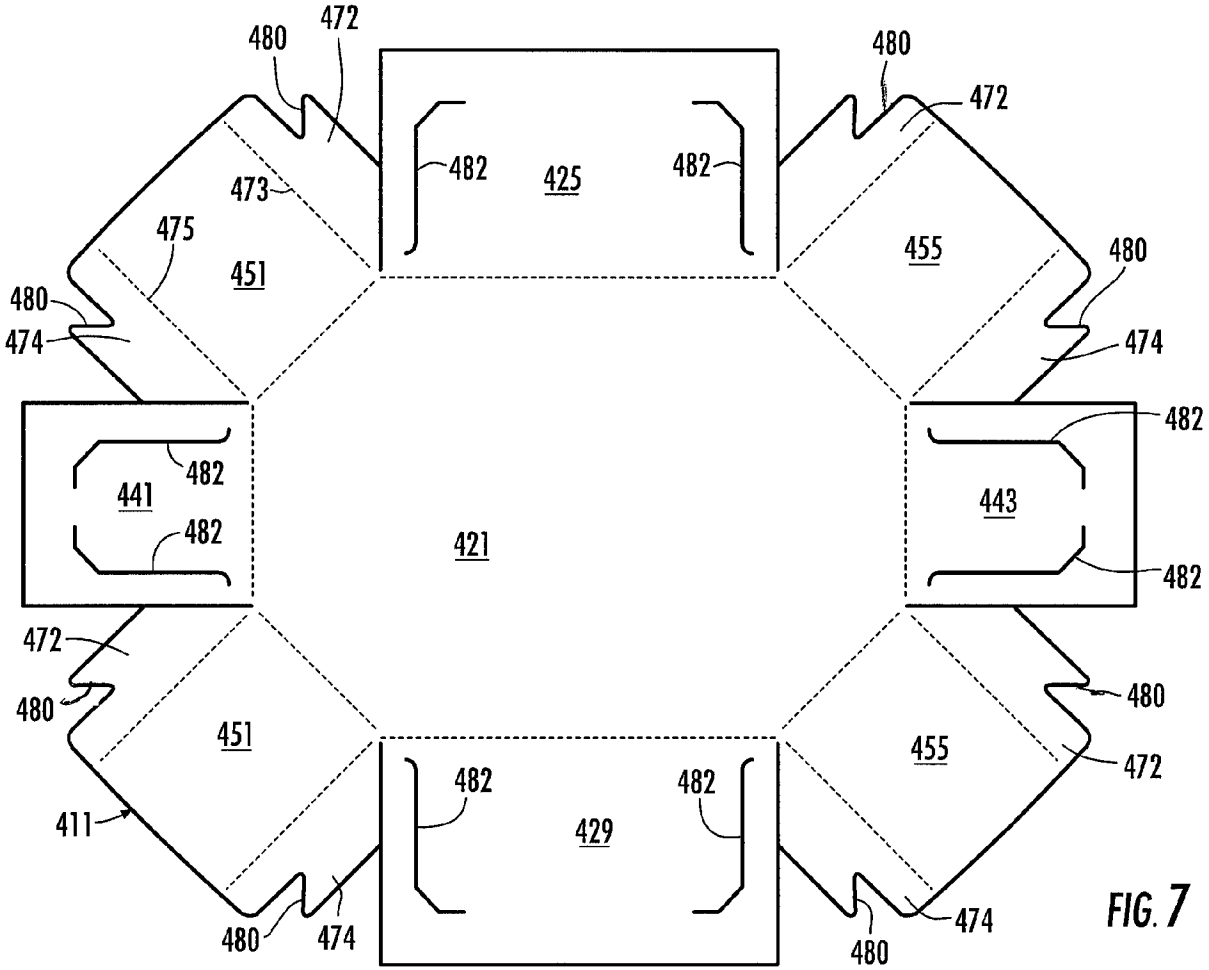
FIGS. 7-8B illustrate a third embodiment of the disclosure.
Figure 8A:
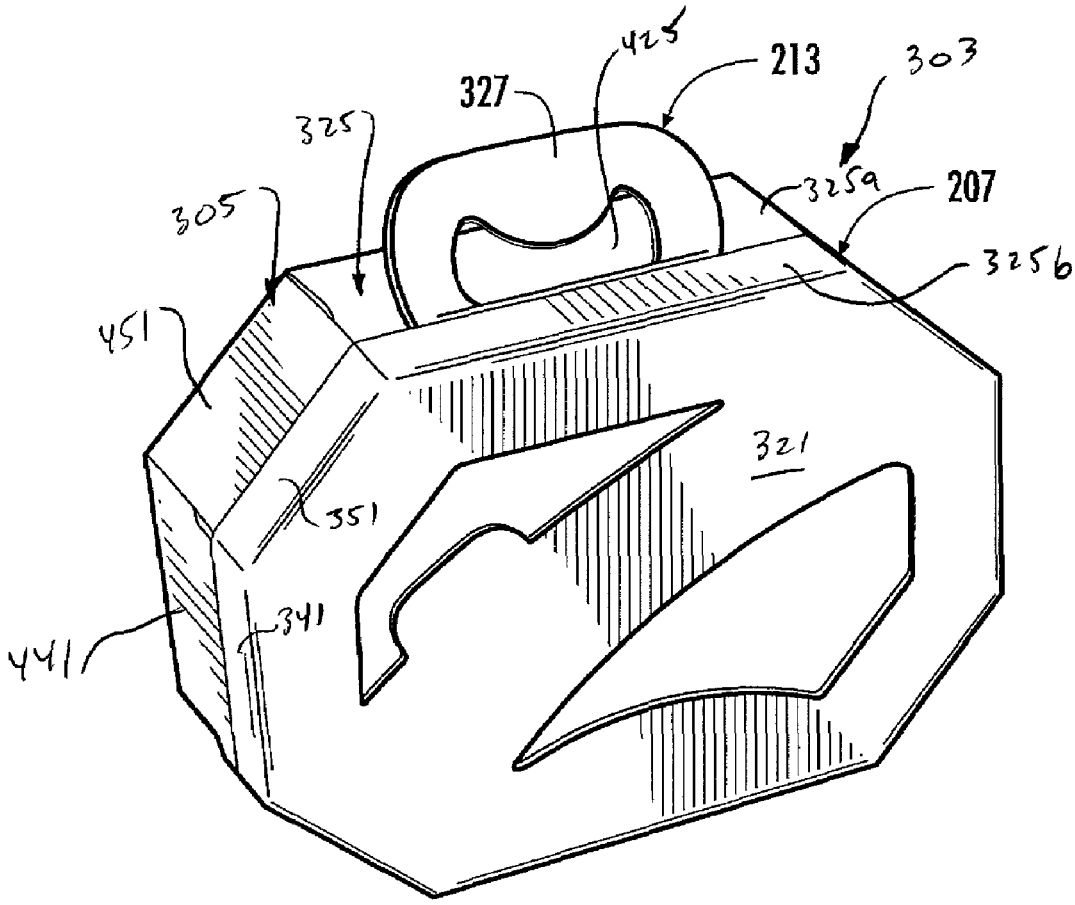
Figure 8B:
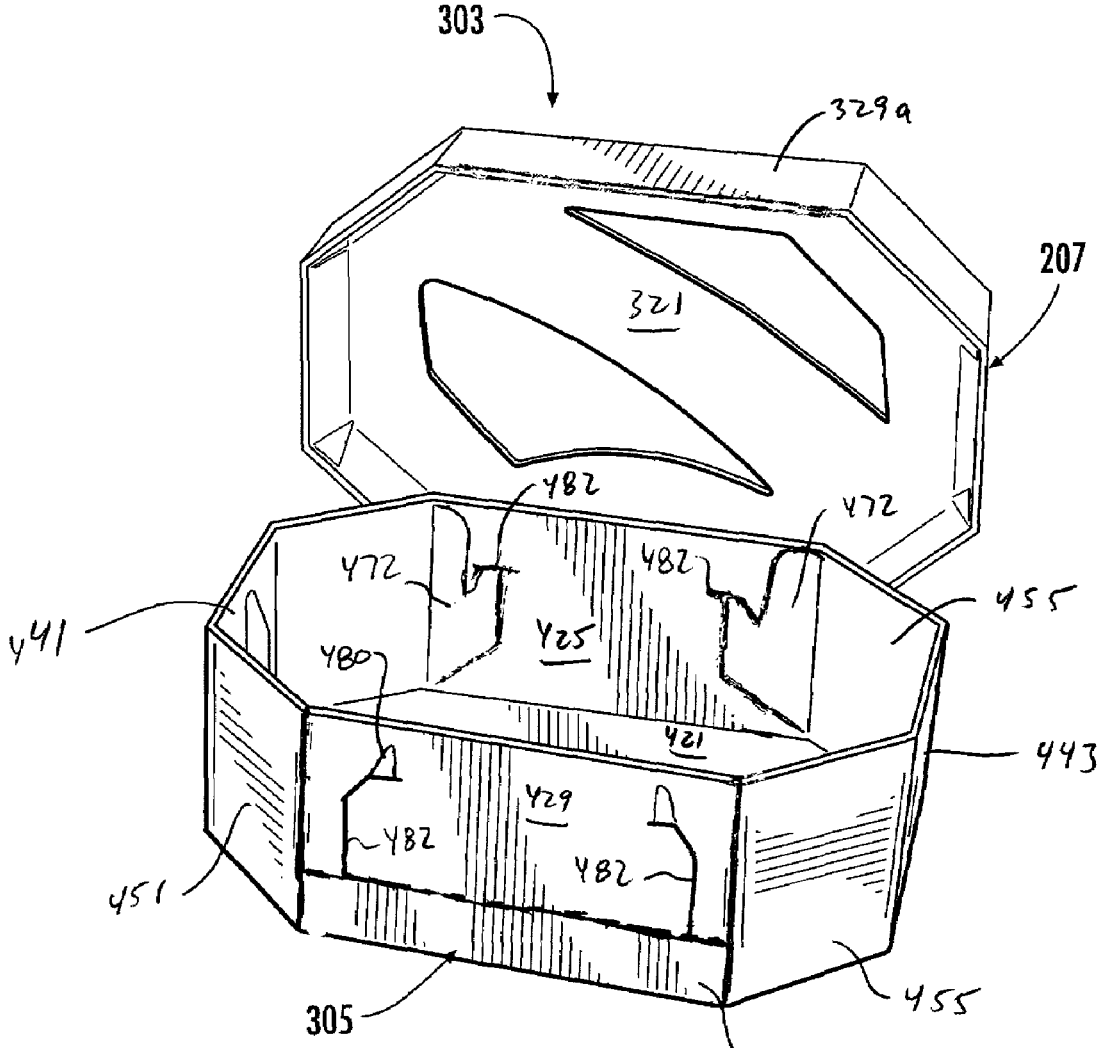

FIGS. 7-8B illustrate various features of a third embodiment of a package 303 of the present disclosure having similar features as the previous embodiments. Accordingly, similar or identical features of the embodiments are provided with like reference numbers. The package 303 includes a tray 305 formed from a tray blank 411 (FIG. 7) and the lid 207 from the previous embodiment. The package 303 could comprise a lid other than the lid 207 shown in FIG. 8 without departing from the disclosure.

As shown in FIG. 7, the tray blank 411 includes a tray central panel 421, tray side panels 425, 429, and tray end panels 441, 443, 451, 455. In the illustrated embodiment, the tray end panels 451, 455 have tray end flaps 472, 474 with locking edges 480 (broadly "locking projections"). Each of the tray end flaps 441, 443 and tray side panels 425, 429 have two cuts 482 or openings (broadly "locking openings") for receiving a respective locking edge 480 of an adjacent tray end flap 472, 474. The tray blank 411 could be otherwise shaped, arranged, and/or configured without departing from the disclosure.

The tray 305 is assembled by upwardly folding the tray side panels 425, 429 and tray end panels 441, 443 relative to the tray central panel 421. The tray end flaps 472, 474 are folded about respective fold lines 473, 475 and the locking edges 480 are inserted into a respective cut 482 in an adjacent tray side end panel 425, 429 or tray end panel 441, 443. The locking edges 480 are shaped for interlocking engagement with a respective tray side end panel 425, 429 or tray end panel 441, 443 when the tray end flaps 472, 474 are inserted into the opening 482. The tray end flaps 472, 474 and locking edges 480 could be otherwise shaped without departing from the disclosure. Further, the tray end panels 441, 443, 451, 455 and tray side panels 425, 429 could be maintained in the upright position forming the tray 305 by other interlocking flap and panel features or other means (e.g., adhesive).

The lid 207 is formed from the lid blank 311 in a similar manner as discussed above. The lid 207 is placed on the tray 305 to close the package 303 and can be attached to the tray in a similar manner as discussed for the previous embodiments. The handle 213 can be activated by folding the handle flap 327 relative to the package 303. The lid 207 can be removed from the tray 305 in a similar manner as discussed above by removing the tear strip 328 to separate the lower portion 329*b* of the lid side wall 329 from the upper portion 329*a* of the lid side wall. The lower portion 329*b* of the lid side wall 329 can be adhesively secured to the tray side wall 429 of the tray 305.

Figure 9:
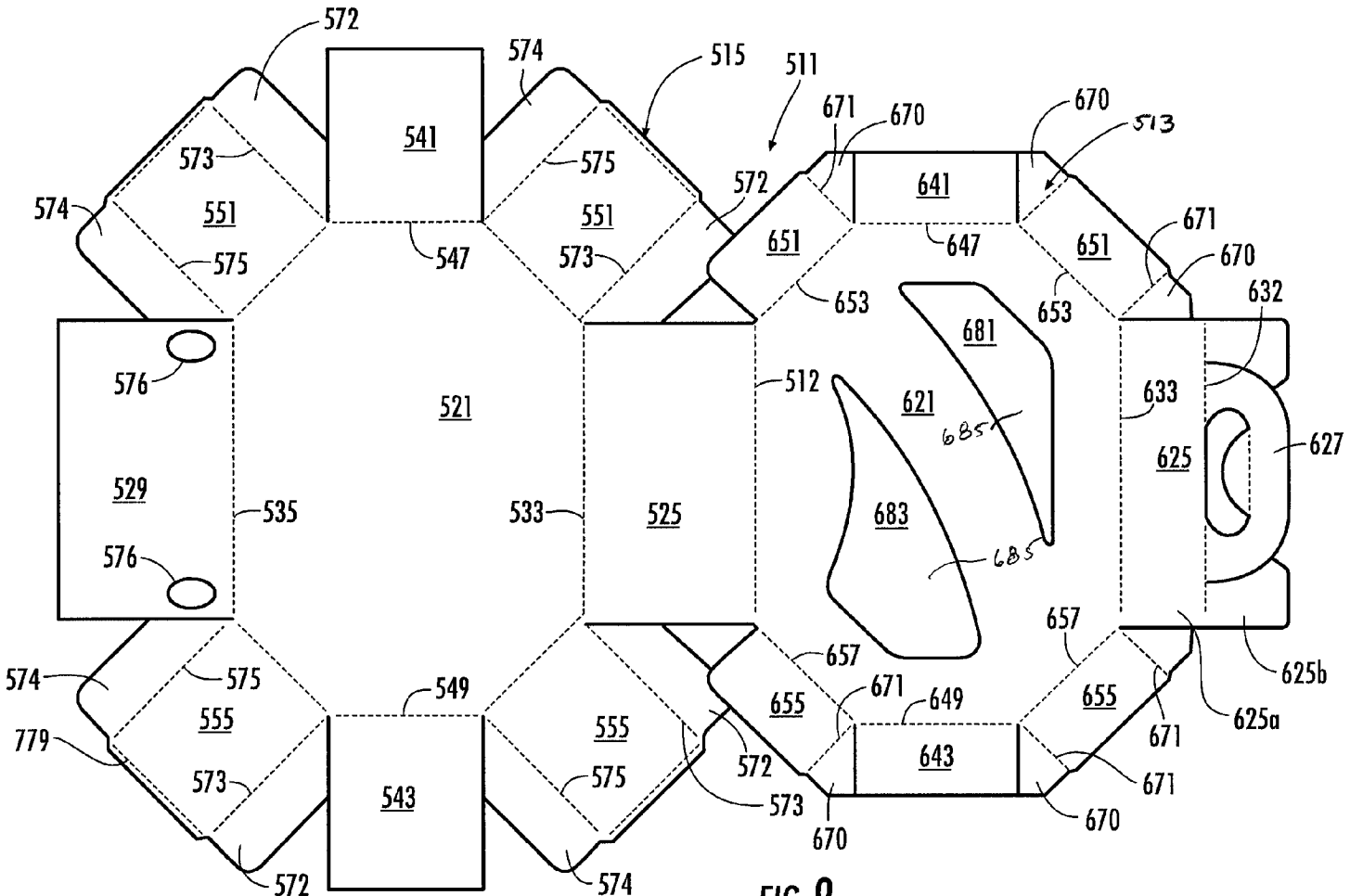
FIGS. 9-10B illustrate a fourth embodiment of the disclosure.
Figure 10A:
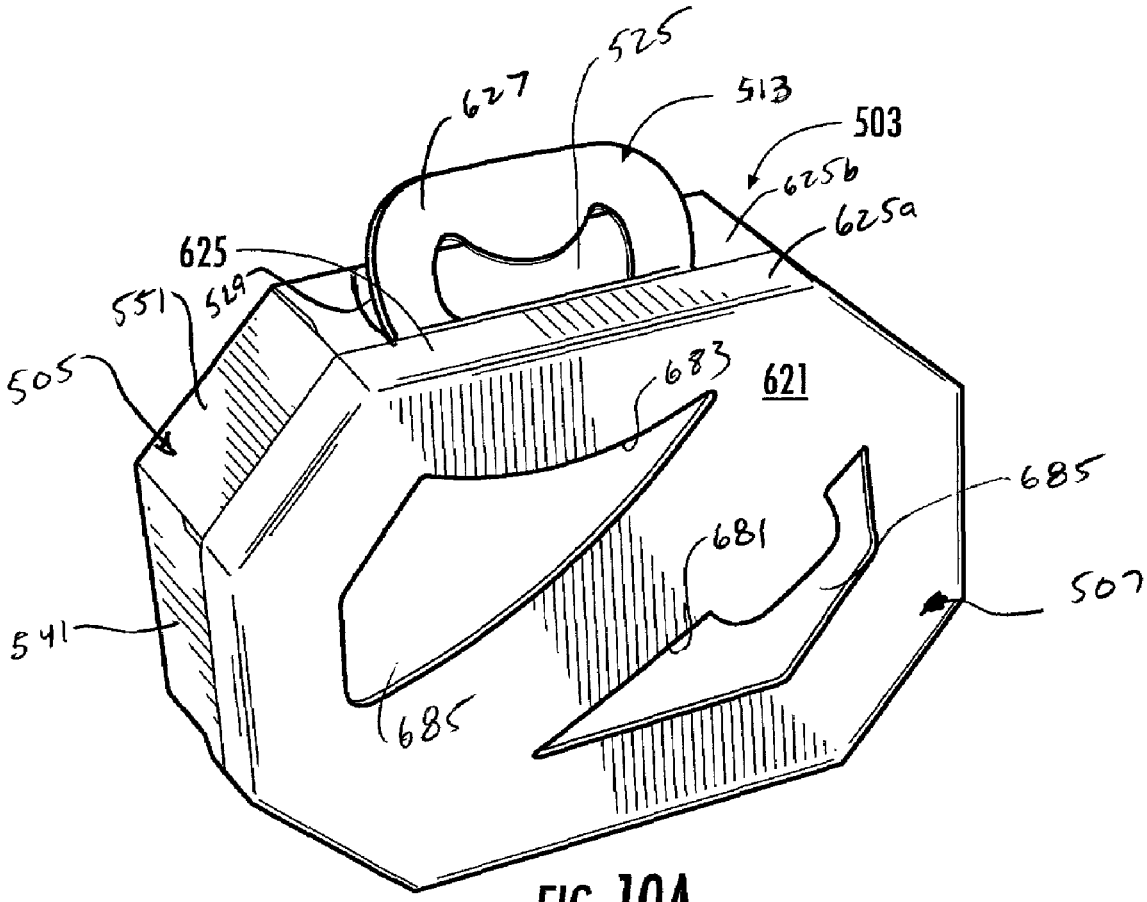
Figure 10B:
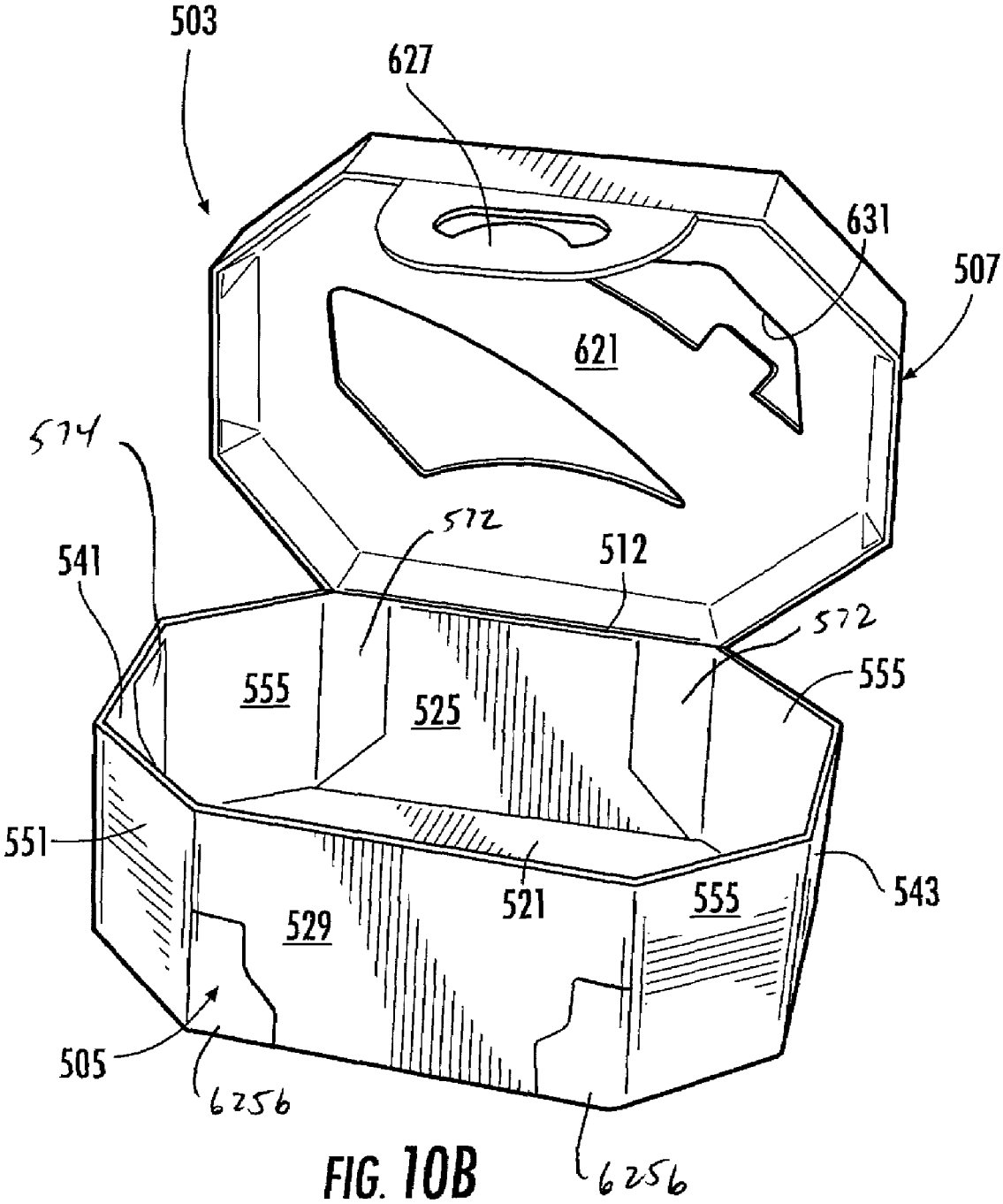

FIGS. 9-10B illustrate various features of a fourth embodiment of a package 503 of the present disclosure. The fourth embodiment has similar features as the previous embodiments. Accordingly, similar or identical features of the embodiments are provided with like reference numbers. The package 503 includes a tray 505 and a lid 507 that is hingedly connected to the tray. The package 503 is formed from a one-piece blank 511 that comprises a lid portion 513 and a tray portion 515 foldably connected to the lid portion at a fold line 512.

In the illustrated embodiment, the tray portion 515 of the blank 511 is similar in shape and construction as the tray blank 211 of FIG. 4. The tray portion 515 comprises a tray central panel 521, tray side panels 525, 529 foldably connected to the tray central panel at respective fold lines 533, 535, tray end panels 541, 543, 551, 555 foldably connected to the tray central panel at respective fold lines 547, 549, 553, 557, and tray end flaps 572, 574 foldably connected to respective tray end panels 551, 555 at fold lines 573, 575. In the illustrated embodiment, one of the tray side panels 529 includes adhesive 576 for securing the tray end panels 551, 555 to the tray side panel. The tray portion 515 could include adhesive on other panels or flaps without departing from the disclosure.

In the illustrated embodiment, the lid portion 513 of the blank 511 is similar in shape and construction as the lid blank 311 of FIG. 5. The lid portion 513 comprises a lid central panel 621, a lid side panel 625 foldably connected to the lid central panel at a fold line 633, and lid end panels 641, 643, 651, 655 foldably connected to the lid central panel at respective fold lines 647, 649, 653, 657. The lid central panel 621 of the lid portion 513 is foldably connected to the tray side panel 525 of the tray portion 515 at the fold line 512. The lid portion 513 includes lid end flaps 670 foldably connected to lid end panels 651, 655 at fold lines 671. The lid central panel 621 includes apertures 681, 683 that are covered by a transparent film 685. The lid portion 513 and/or the tray portion 515 of the blank 511 could be otherwise shaped, arranged, and/or configured without departing from the disclosure.

As shown in FIG. 10A, the package 503 is formed by forming the tray 505 from the lid portion 513 of the blank 511 and forming the lid 507 from the lid portion 513 of the blank. The lid 507 can be lowered by downwardly folding the lid relative to the fold line 512 to close the package 503. As with the previous embodiments, the handle 514 can be used by upwardly folding the handle flap 627 and grasping the package 503 at the handle flap. The package 503 can be opened by upwardly folding the lid 507 relative to the fold line 512. The package 503 can be formed, closed, and/or opened by other steps, or the package can include alternative configurations without departing from the disclosure.

Figure 11:
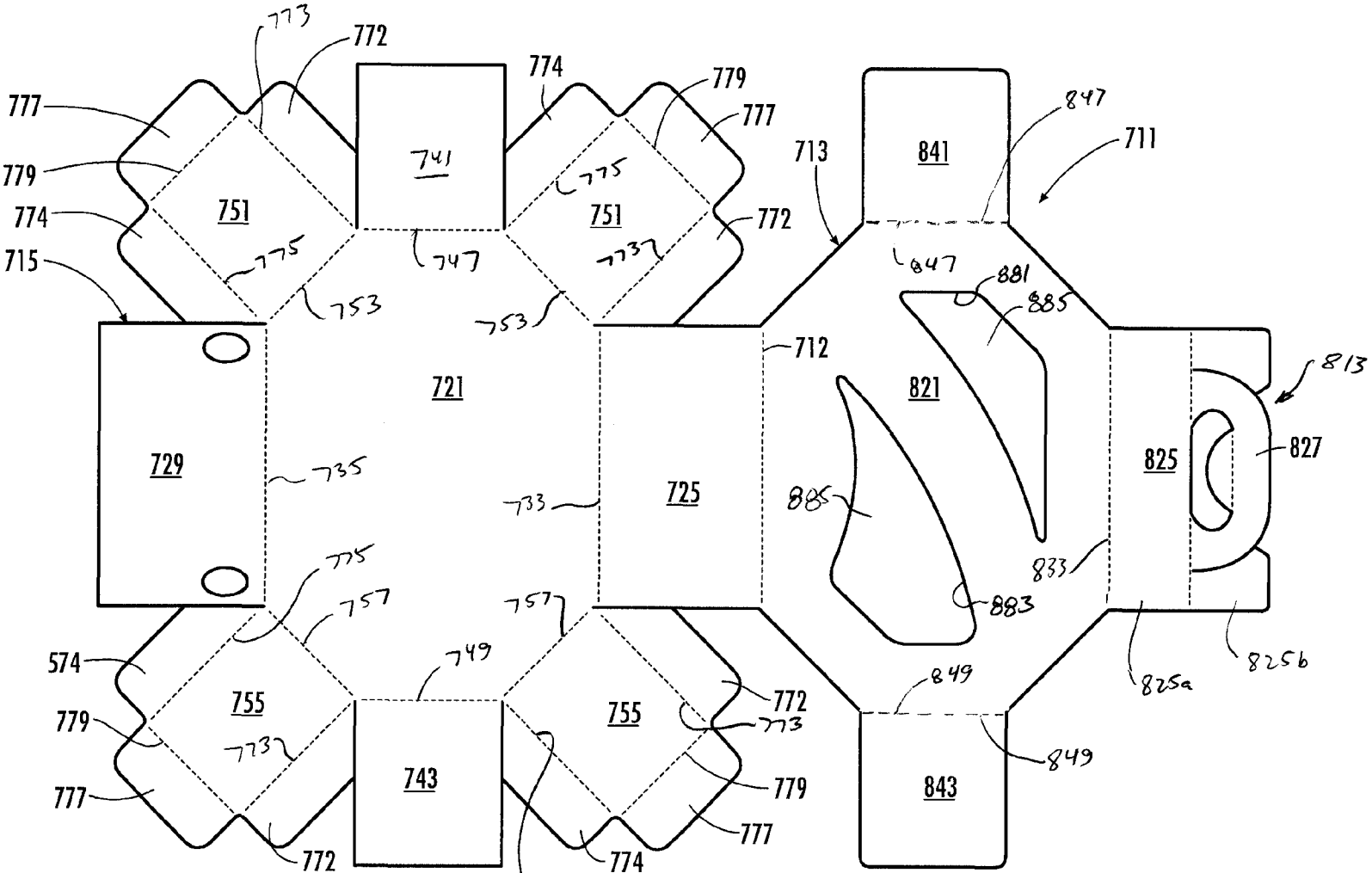
FIGS. 11-13 illustrate a fifth embodiment of the disclosure.
Figure 12A:
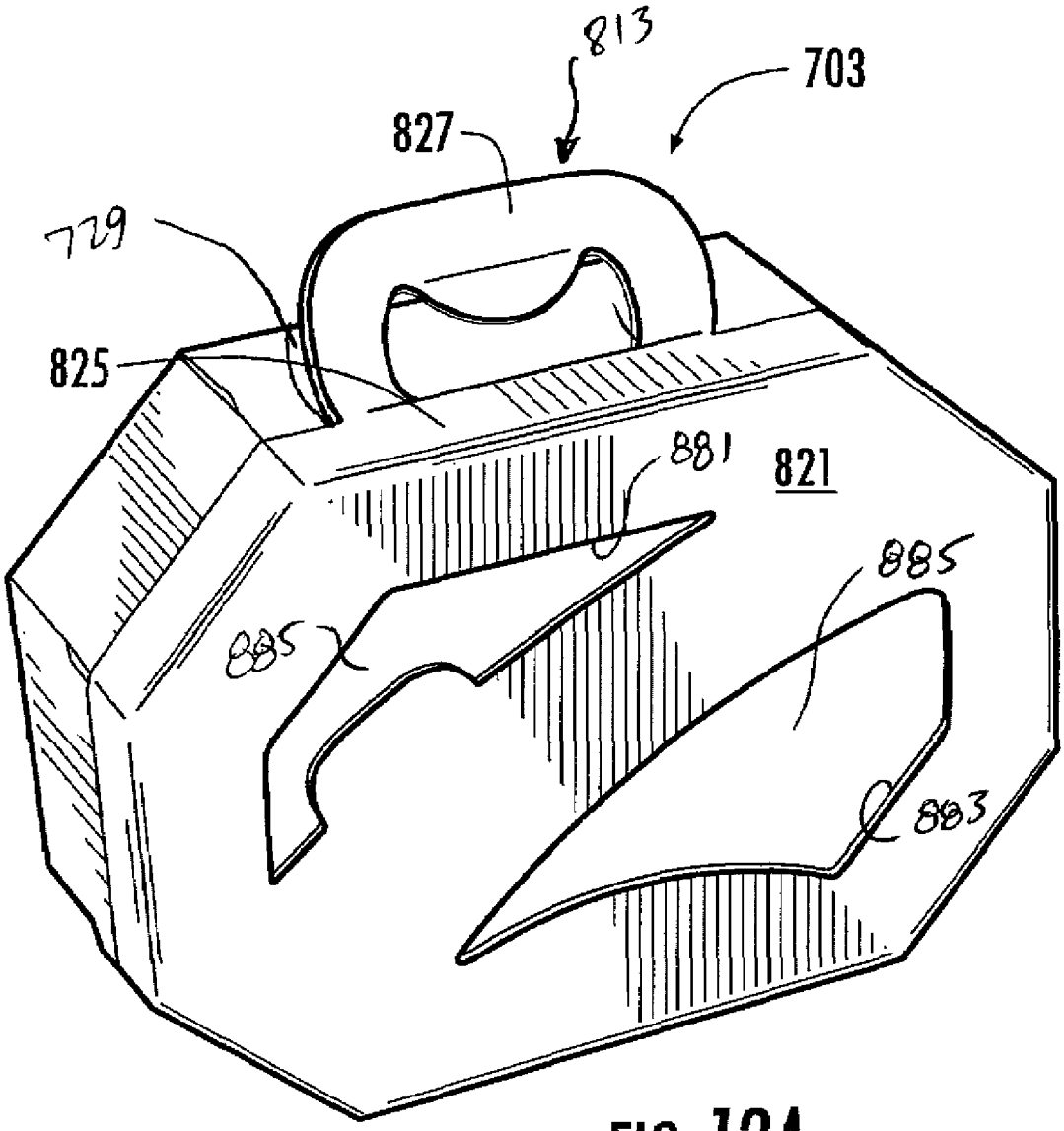
Figure 12B:
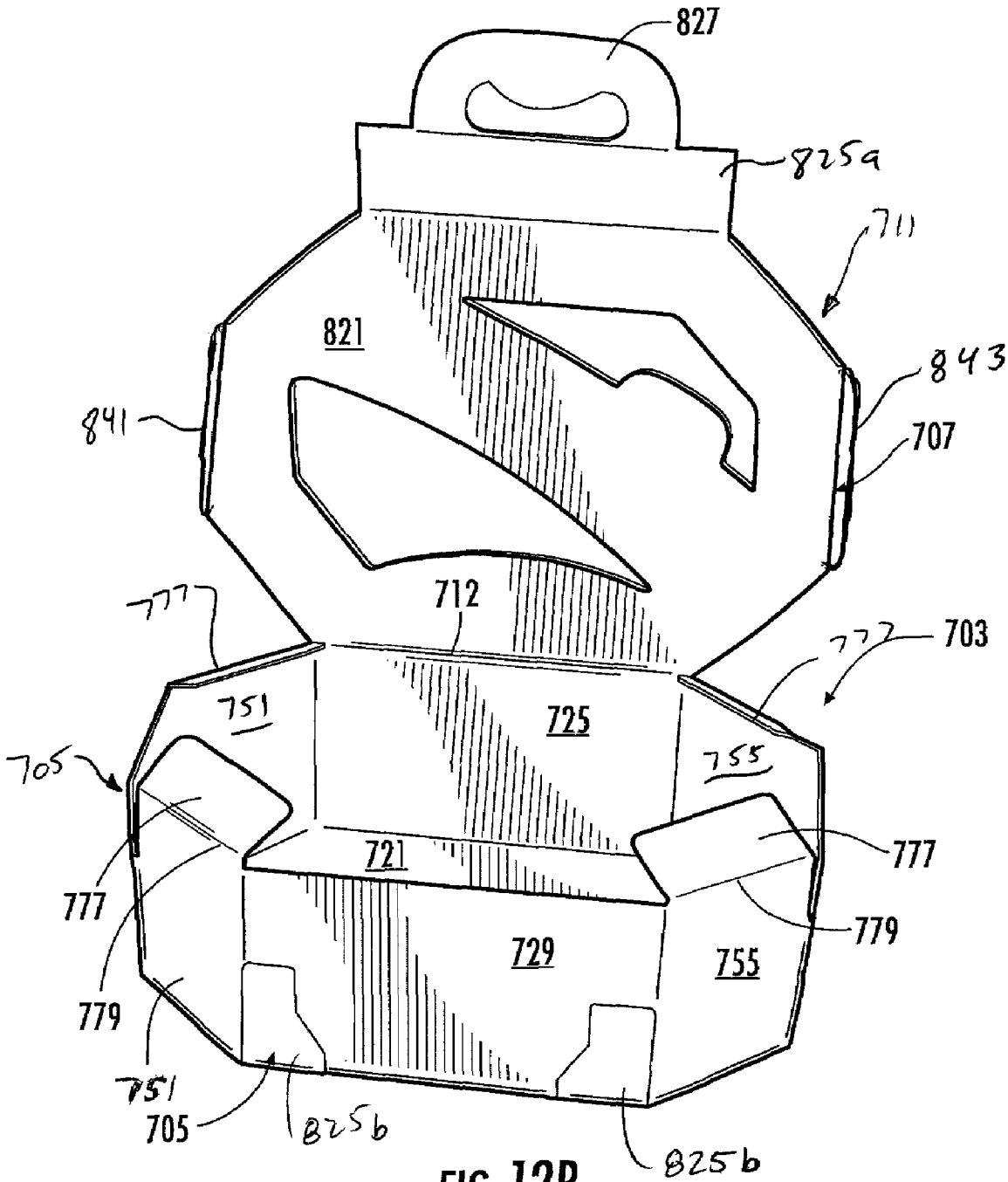
Figure 13:
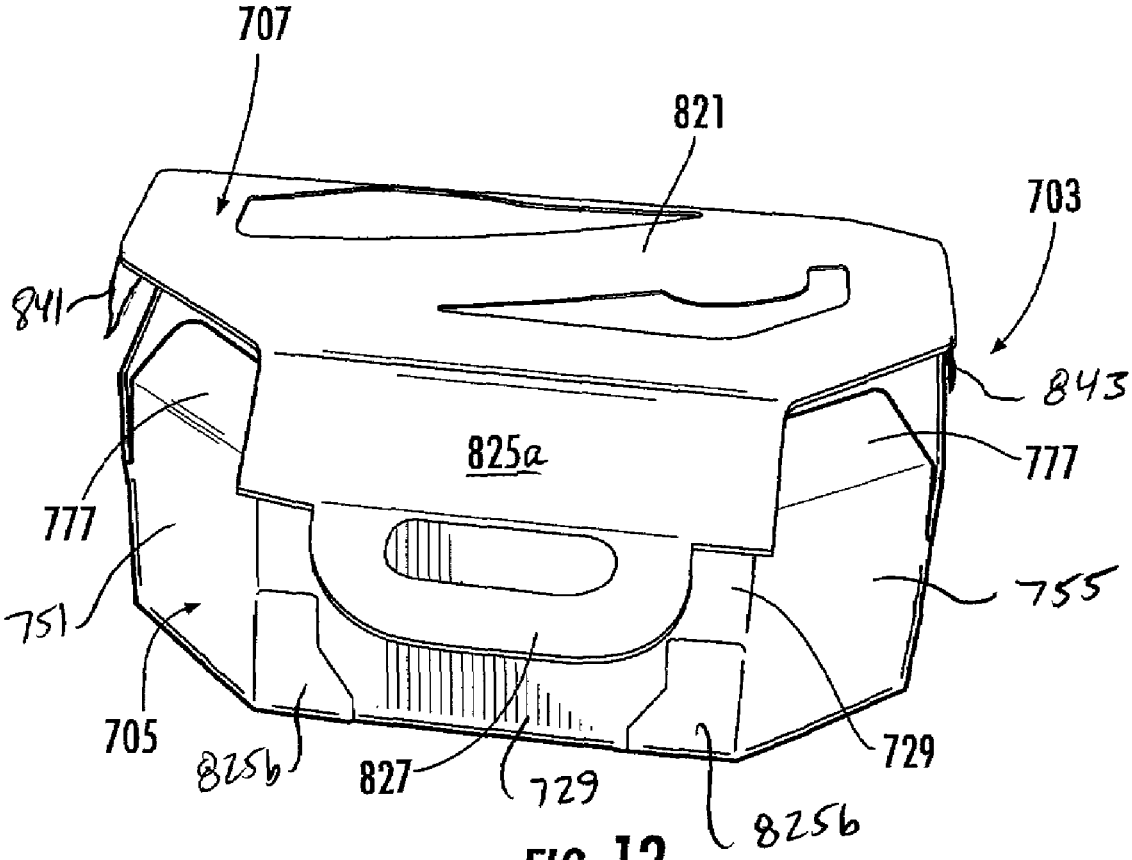

FIGS. 11-13 illustrate various features of a fifth embodiment of a package 703 of the present disclosure having similar features as the previous embodiments. Accordingly, similar or identical features of the embodiments are provided with like reference numbers. As with the previous embodiment, the package 703 includes a tray 705 and a lid 707 that is hingedly connected to the tray. The package 703 is formed from a one-piece blank 711 that comprises a lid portion 713 and a tray portion 715 foldably connected to the lid portion at a fold line 712.

In the fifth embodiment, the tray portion 715 comprises a tray central panel 721, tray side panels 725, 729 foldably connected to the tray central panel at respective tray fold lines 733, 735, tray end panels 741, 743, 751, 755 foldably connected to the tray central panel at respective fold lines 747, 749, 753, 757, and tray end flaps 772, 774 foldably connected to respective tray end panels 751, 755 at fold lines 773, 775. The tray portion 715 of the blank 711 is similar to the tray portion 515 of the previous embodiment except that each tray end panel 751, 755 includes an additional tray end flap 777 at the distal end of each tray end panel and foldably connected to the tray end panel at a fold line 779. The tray portion 715 could be otherwise shaped, arranged, and/or configured without departing from the disclosure.

In the fifth embodiment, the lid portion 713 comprises a lid central panel 821, a lid side panel 825 foldably connected to the lid central panel at a fold line 833, and lid end panels 641, 643 foldably connected to the lid central panel at respective fold lines 647, 649. The central panel 821 of the lid portion 813 is foldably connected to the lid side panel 725 of the tray portion 715 at the fold line 712. The lid central panel 821 includes apertures 881, 883 that are covered by a transparent film 885. The lid portion 813 is similar to the lid portion 513 of the previous embodiment except that the lid portion of FIG. 11 includes only two lid end panels 841. The two lid end panels 841, 843 can be removably connected to the lid central panel 821 at respective tear lines 847, 849. Alternatively, the lid end panels 841, 843 can be foldably connected to the lid central panel 821 at a fold line.

The lid portion 713 comprises a handle 813 that can be activated by folding the handle flap 827 relative to the package 703. The lid 707 can be opened or removed from the tray 705 by grasping the handle flap 827 and raising the lid 707 upward about fold line 712. The lower portion 825*b* of the lid side panel 825 can be adhesively secured to the tray side panel 729 of the tray 705 and the handle flap 827 and upper portion 825*a* of the lid side panel 825 can be free from adhesive attachment to the tray. As shown in FIG. 12B, when the lid 711 is opened, the lower portion 825*b* of the lid side panel remains adhesively attached to the tray side panel 729.

As shown in FIG. 12B, the tray end flaps 777 can be downwardly folded at fold lines 777, 779 to at least partially contain a food produce (not shown) that is located in the tray 705. The tray portion 711 and tray 705 and the lid portion 713 and the lid 711 could be otherwise shaped, arranged and/or configured without departing from the disclosure.

The packages of the various illustrated embodiments are useful in providing a package containing a food product, the package comprising a tray and a lid. The tray is configured to folded flat and used as a placemat for placing the food product during consumption. The package has a generally octagonal shape and can have a handle that can be used to both carry the closed package and lift the lid to open the package.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package for holding a food product, the package comprising:

a tray for holding the food product, the tray comprising a tray central panel, a first tray side panel foldably connected to the tray central panel, a second tray side panel foldably connected to the tray central panel, a plurality of first tray end panels foldably connected to the tray central panel at a first end of the tray central panel, wherein each first tray end panel of the plurality of first tray end panels is foldably connected to the central panel along a respective first fold line, and at least one of the first tray end panels has a first end flap foldably connected at a first side of the at least one first tray end panel and a second end flap foldably connected at a second side of the at least one first tray end panel, and a plurality of second tray end panels foldably connected to the central panel at a second end of the central panel, wherein each second tray end panel of the plurality of second tray end panels is foldably connected to the central panel along a respective second fold line, and at least one of the second tray end panels has a first end flap foldably connected at a first side of the at least one second tray end panel and a second end flap foldably connected at a second side of the at least one second tray end panel, wherein each of the first tray side panel, the second tray side panel, at least one of the first tray end panels, and at least one of the second tray end panels having a respective locking opening, and the first end flaps and the second end flaps each have a locking projection for interlocking engagement with a respective locking opening; and a lid for covering the tray, the lid comprising a lid central panel, at least one lid side panel comprising an upper portion and a lower portion, the upper portion is foldably connected to the lid central panel, the lower portion of the at least one lid side panel comprises a handle panel forming a handle of the package, the handle panel being foldably connected to the upper portion of the at least one lid side panel and at least one lid end panel foldably connected to the lid central panel at one of a first end and a second end of the lid central panel.

2. The package of claim 1 wherein the at least one lid side panel is a first lid side panel and the lid further comprises a second lid side panel, the second lid side panel comprising an upper portion foldably connected to the lid central panel and a lower portion removably connected to the upper portion by a tear strip.

3. The package of claim 2 wherein the lower portions of the first and second lid side panel are respectively adhesively connected to one of the first tray side panel and the second tray side panel.

4. The package of claim 1 wherein the lower portion of the at least one lid side panel is at least partially adhesively connected to the one of the first tray side panel and the second tray side panel.

5. The package of claim 1 wherein the at least one lid end panel comprises a plurality of first lid end panels at a first end of the lid central panel, the lid comprises a plurality of second lid end panels at a second end of the lid central panel, the lid comprises two first end flaps foldably connected to a respective one of the first lid end panels and two second end flaps foldably connected to a respective one of the second lid end panels.

6. The package of claim 1 wherein the lid is hingedly connected to the tray.

7. The package of claim 1 wherein the lid central panel comprises at least one window comprising an opening and transparent material covering the opening.

8. The package of claim 1 wherein each of the first end flaps has adhesive for securing the respective first end flap to the first tray side panel and each of the second end flaps has adhesive for securing the respective second end flap to a respective one of the first end panels and the second end panels.

9. The package of claim 1 wherein the at least one of the first tray end panels has a third end flap foldably connected to a respective end of the at least one first tray end panel, and the at least one of the second tray end panels has a third end flap foldably connected to a respective end of the at least one second tray end panel.

10. The package of claim 1, wherein at least two first tray end panels of the plurality of first tray end panels are foldably connected to the central panel along respective oblique fold lines, and at least one first tray end panel of the plurality of first tray end panels is foldably connected to the central panel along a lateral fold line.

11. In combination, a tray blank and a lid blank for forming a package for holding a food product, the tray blank being for forming a tray for holding the food product, the tray blank comprising:

a tray central panel, a first tray side panel foldably connected to the tray central panel, a second tray side panel foldably connected to the tray central panel, a plurality of first tray end panels foldably connected to the tray central panel at a first end of the tray central panel, wherein each first tray end panel of the plurality of first tray end panels is foldably connected to the central panel along a respective first fold line, and at least one of the first tray end panels has a first end flap foldably connected at one side of the at least one first tray end panel and a second end flap foldably connected at a second side of the at least one first tray end panel, and a plurality of second tray end panels foldably connected to the central panel at a second end of the central panel, wherein each second tray end panel of the plurality of second tray end panels is foldably connected to the central panel along a respective second fold line, and at least one of the second tray end panels has a first end flap foldably connected at one side of the at least one second tray end panel and a second end flap foldably connected at a second side of the at least one second tray end panel, wherein each of the first tray side panel, the second tray side panel, at least one of the first tray end panels, and at least one of the second tray end panels has a respective locking opening, and the first end flaps and the second end flaps each have a respective locking projection for interlocking engagement with a respective locking opening when the tray blank is formed into the tray; and the lid blank being for forming a lid for covering the tray, the lid blank comprising a lid central panel, at least one lid side panel comprising an upper portion and a lower portion, the upper portion is foldably connected to the lid central panel, the lower portion of the at least one lid side panel comprises a handle panel for forming a handle of the package formed from the lid blank and the tray blank, the handle panel being foldably connected to the upper portion of the at least one lid side panel, and at least one lid end panel foldably connected to the lid central panel at one of a first end and a second end of the lid central panel.

12. The combination of claim 11 wherein the at least one lid side panel is a first lid side panel and the lid further comprises a second lid side panel, the second lid side panel comprising an upper portion foldably connected to the lid central panel and a lower portion removably connected to the upper portion by a tear strip, the lower portions of the first and second lid side panel are for being respectively adhesively connected to one of the first tray side panel and the second tray side panel when the tray blank and the lid blank are formed into a package.

13. The combination of claim 11 wherein the at least one lid end panel comprises a plurality of first lid end panels at a first end of the lid central panel, the lid comprises a plurality of second lid end panels at a second end of the lid central panel, the lid comprises two first end flaps foldably connected to a respective one of the first lid end panels and two second end flaps foldably connected to a respective one of the second lid end panels.

14. The combination of claim 11 wherein each of the first end flaps has adhesive for securing the respective first end flap to the first tray side panel when the tray blank is formed into the tray, and each of the second end flaps has adhesive for securing the respective second end flap to a respective one of the first end panels and the second end panels when the tray blank is formed into the tray.

15. The combination of claim 11 wherein at least one of the first tray end panels has a third end flap foldably connected to a respective end of the at least one first tray end panel, and at least one of the second tray end panels has a third end flap foldably connected to a respective end of the at least one second tray end panel.

16. The combination of claim 11, wherein at least two first tray end panels of the plurality of first tray end panels are foldably connected to the central panel along respective oblique fold lines, and at least one first tray end panel of the plurality of first tray end panels is foldably connected to the central panel along a lateral fold line.

17. A method of forming a package for holding a food product, the method comprises:

obtaining a tray blank, the tray blank comprises a tray central panel, a first tray side panel foldably connected to the tray central panel, a second tray side panel foldably connected to the tray central panel, a plurality of first tray end panels foldably connected to the tray central panel at a first end of the tray central panel, wherein each second tray end panel of the plurality of second tray end panels is foldably connected to the central panel along a respective first fold line, and at least one of the first tray end panels has a first end flap foldably connected at a first side of the at least one first tray end panel and a second end flap foldably connected at a second side of the at least one first tray end panel, and a plurality of second tray end panels foldably connected to the central panel at a second end of the central panel, wherein each second tray end panel of the plurality of second tray end panels is foldably connected to the central panel along a respective second fold line, and at least one of the second tray end panels has a first end flap foldably connected at a first side of the at least one second tray end panel and a second end flap foldably connected at a second side of the at least one second tray end panel, wherein each of the first tray side panel, the second tray side panel, at least one of the first tray end flaps, and at least one of the second tray end panels have a respective locking opening, and the first end flaps and the second end flaps each have a respective locking projection;

obtaining a lid blank, the lid blank comprises a lid central panel, at least one lid side panel comprising an upper portion and a lower portion, the upper portion is foldably connected to the lid central panel, the lower portion of the at least one lid side panel comprises a handle panel and the method comprises forming a handle of the package by positioning the handle panel relative to the at least one lid side panel, and at least one lid end panel foldably connected to the lid central panel at one of a first end and a second end of the lid central panel;

forming the tray from the tray blank, the forming the tray comprising positioning the first tray side panel, second tray side panel, first tray end panels, second tray end panels, first end flaps, and second end flaps relative to the tray central panel and placing a respective locking projection in interlocking engagement with a respective locking opening;

forming the lid from the lid blank; and positioning the lid to cover the tray and close the package.

18. The method of claim 17 wherein the at least one lid side panel is a first lid side panel and the lid further comprises a second lid side panel, the second lid side panel comprising an upper portion foldably connected to the lid central panel and a lower portion removably connected to the upper portion by a tear strip, the positioning the lid comprises adhesively connecting the lower portions of the first and second lid side panel to one of the first tray side panel and the second tray side panel.

19. The method of claim 18 further comprising opening the package by tearing each tear strip to separate each respective upper portion of the first lid side panel and the second lid side panel from a respective lower portion of the first lid side panel and the second lid side panel.

20. The method of claim 17 wherein the at least one lid end panel comprises a plurality of first lid end panels at a first end of the lid central panel, the lid comprises a plurality of second lid end panels at a second end of the lid central panel, the lid comprises two first end flaps foldably connected to a respective one of the first lid end panels and two second end flaps foldably connected to a respective one of the second lid end panels, forming the lid comprises positioning the first lid end panels, second lid end panels, first end flaps, and second end flaps relative to the lid central panel.

21. The method of claim 17 wherein the forming the tray comprises adhesively securing each of the first end flaps to the first tray side panel, and adhesively securing each of the second end flaps to a respective one of the first end panels and the second end panels.

22. The method of claim 17, wherein at least two first tray end panels of the plurality of first tray end panels are foldably connected to the central panel along respective oblique fold lines, and at least one first tray end panel of the plurality of first tray end panels is foldably connected to the central panel along a lateral fold line.

23. A package for holding a food product, the package comprising:

a tray for holding the food product, the tray comprising a tray central panel, a first tray side panel foldably connected to the tray central panel, a second tray side panel foldably connected to the tray central panel, a plurality of first tray end panels foldably connected to the tray central panel at a first end of the tray central panel, wherein each second tray end panel of the plurality of second tray end panels is foldably connected to the central panel along a respective first fold line, and a plurality of second tray end panels foldably connected to the central panel at a second end of the central panel, wherein each second tray end panel of the plurality of second tray end panels is foldably connected to the central panel along a respective second fold line; and a lid for covering the tray, the lid comprising a lid central panel, at least one lid side panel foldably connected to the lid central panel, and at least one lid end panel foldably connected to the lid central panel at one of a first end and a second end of the lid central panel, at least one of the first tray end panels has a first end flap foldably connected at a first side of the at least one first tray end panel, a second end flap foldably connected at a second side of the at least one first tray end panel, and a third end flap foldably connected to a respective end of the at least one first tray end panel, and at least one of the second tray end panels has a first end flap foldably connected at a first side of the at least one second tray end panel, a second end flap foldably connected at a second side of the at least one second tray end panel, and a third end flap foldably connected to a respective end of the at least one second tray end panel;

wherein each of the first tray side panel, the second tray side panel, at least one of the first tray end panels, and at least one of the second tray end panels have a respective locking opening, and the first end flaps and the second end flaps each have a locking projection for interlocking engagement with a respective locking opening.

24. In combination, a tray blank and a lid blank for forming a package for holding a food product, the tray blank being for forming a tray for holding the food product, the tray blank comprising a tray central panel, a first tray side panel foldably connected to the tray central panel, a second tray side panel foldably connected to the tray central panel, a plurality of first tray end panels foldably connected to the tray central panel at a first end of the tray central panel, wherein each second tray end panel of the plurality of second tray end panels is foldably connected to the central panel along a respective first fold line, and a plurality of second tray end panels foldably connected to the central panel at a second end of the central panel, wherein each second tray end panel of the plurality of second tray end panels is foldably connected to the central panel along a respective second fold line; and the lid blank being for forming a lid for covering the tray, the lid blank comprising a lid central panel, at least one lid side panel foldably connected to the lid central panel, and at least one lid end panel foldably connected to the lid central panel at one of a first end and a second end of the lid central panel, at least one of the first tray end panels has a first end flap foldably connected at a first side of the at least one first tray end panel, a second end flap foldably connected at a second side of the at least one first tray end panel, and a third end flap foldably connected to a respective end of the at least one first tray end panel, and at least one of the second tray end panels has a first end flap foldably connected at a first side of the at least one second tray end panel, a second end flap foldably connected at a second side of the at least one second tray end panel, and a third end flap foldably connected to a respective end of the at least one second tray end panel;

wherein each of the first tray side panel, the second tray side panel, at least one of the first tray end panels, and at least one of the second tray end panels having a respective locking opening, and the first end flaps and the second end flaps each have a respective locking projection for interlocking engagement with a respective locking opening when the tray blank is formed into the tray.

* * * * *